US012544643B2

(12) United States Patent
Brzakovic

(10) Patent No.: US 12,544,643 B2
(45) Date of Patent: Feb. 10, 2026

(54) BALL PERCH SYSTEM

(71) Applicant: Zeljko J. Brzakovic, Palm Desert, CA (US)

(72) Inventor: Zeljko J. Brzakovic, Palm Desert, CA (US)

( * ) Notice: Subject to any disclaimer, the term of this patent is extended or adjusted under 35 U.S.C. 154(b) by 0 days.

(21) Appl. No.: 18/760,289

(22) Filed: Jul. 1, 2024

(65) Prior Publication Data

US 2025/0001277 A1 Jan. 2, 2025

Related U.S. Application Data

(60) Provisional application No. 63/511,114, filed on Jun. 29, 2023.

(51) Int. Cl.
*A63B 71/00* (2006.01)
*A63B 47/00* (2006.01)

(52) U.S. Cl.
CPC ..... *A63B 71/0036* (2013.01); *A63B 47/00* (2013.01)

(58) Field of Classification Search
CPC ... A63B 71/0036; A63B 47/00; A47F 5/0006; A47B 96/061
USPC .... 211/85.7, 14, 100, 99, 106, 18, 171, 193, 211/119.004, 119.009, 75; 248/110, 214, 248/317, 447.1
See application file for complete search history.

(56) References Cited

U.S. PATENT DOCUMENTS 630,430 A * 8/1899 Wildermuth ..... A47G 25/0685 211/100
2,093,802 A * 9/1937 Brown ..... A43D 3/1433 211/35
2,217,795 A * 10/1940 Dawson ..... A47B 61/02 211/100
2,489,472 A * 11/1949 Williams ..... D06F 57/12 211/100
2,778,588 A * 1/1957 Bruno ..... A47L 13/512 248/302
2,951,590 A * 9/1960 Feser ..... A47J 45/00 211/74
3,115,252 A * 12/1963 Scnical ..... A47F 7/005 248/220.42
3,484,069 A * 12/1969 Larson ..... A47F 5/0823 211/100
4,205,629 A * 6/1980 Wix ..... A01K 5/0114 D6/558
4,289,243 A * 9/1981 Arbuzoff ..... A47L 23/20 211/100

(Continued)

*Primary Examiner* — Jennifer E. Novosad

(57) ABSTRACT

Systems and methods to support one or more articles of exercise or fitness equipment. One aspect includes a base plate configured to be rigidly mounted to a rigid vertical attachment surface. A first elongated bar and a second elongated bar may each have a first end rigidly connected to the base plate at a first and second position, respectively. The first elongated bar and the second elongated bar may project outwards relative to the base plate. A second end of the first elongated bar and a second end of the second elongated bar may be at a higher elevation as compared to the first ends of the first elongated bar and the second elongated bar, respectively. A substantially rigid structure comprised of the vertical attachment surface, the base plate, the first elongated bar, and the second elongated bar may be configured to support an exercise ball.

4 Claims, 27 Drawing Sheets

(56) References Cited

U.S. PATENT DOCUMENTS 4,360,109 A * 11/1982 Kurtz ..... D06F 57/12 211/100
4,749,089 A * 6/1988 Stewart, III ..... B62H 3/12 248/447
4,909,467 A * 3/1990 Shan-Pao ..... B25H 3/04 24/537
5,054,628 A * 10/1991 Allen ..... B62H 3/12 211/100
5,078,276 A * 1/1992 Rogge ..... B62H 3/12 248/289.11
5,209,359 A * 5/1993 Arnold ..... A63B 60/58 211/14
5,332,104 A * 7/1994 Santella ..... B62H 3/02 211/99
5,369,835 A * 12/1994 Clarke ..... A46B 5/02 15/176.1
5,388,709 A * 2/1995 Adams ..... A47B 81/005 211/106
5,711,436 A * 1/1998 Moeller ..... A47G 23/0208 248/312.1
5,842,581 A * 12/1998 Graefe ..... B62H 3/00 211/119.004
D417,353 S * 12/1999 Laga ..... D6/552
6,019,232 A * 2/2000 Heneveld ..... A47F 7/08 248/300
D437,164 S * 2/2001 Fickett ..... D6/552
6,196,509 B1 * 3/2001 Clemens ..... A45F 5/00 248/302
6,443,316 B1 * 9/2002 Mao ..... A47L 19/04 211/74
6,454,105 B1 * 9/2002 Medina ..... A63B 47/00 D6/552
6,561,362 B1 * 5/2003 Cummins ..... A47F 7/00 211/49.1
6,679,388 B1 * 1/2004 Chiu ..... B62H 3/12 248/170
6,843,380 B1 * 1/2005 Fickett ..... B62H 3/06 211/17
6,983,853 B1 * 1/2006 Fickett ..... A47F 7/00 248/303
7,334,853 B2 * 2/2008 Ahmed ..... F25D 23/04 312/405.1
7,669,822 B2 * 3/2010 Kluge ..... F16B 45/00 248/306
7,819,366 B2 * 10/2010 Paga, Jr. ..... B44D 3/123 248/302
7,959,020 B2 * 6/2011 Rosen ..... D06F 79/02 248/302
8,272,610 B2 * 9/2012 Ernst ..... A47L 13/16 248/302
10,750,859 B1 * 8/2020 Fickett ..... A47F 5/083
11,091,213 B2 * 8/2021 Flynn ..... B62H 3/12
2003/0029820 A1 * 2/2003 Heneveld, Sr. ..... B25H 3/04 211/100
2005/0006322 A1 * 1/2005 Kershaw ..... A63B 47/00 211/106
2005/0263466 A1 * 12/2005 Libman ..... A47F 5/0815 211/106
2025/0001277 A1 * 1/2025 Brzakovic ..... A63B 71/023

* cited by examiner

BALL PERCH SYSTEM

RELATED APPLICATION

This application claims the priority benefit of U.S. Provisional Application Ser. 63/511,114, entitled "The Ball Perch System," filed on Jun. 29, 2023 the disclosure of which is hereby incorporated by reference herein in its entirety.

BACKGROUND

Technical Field

The present disclosure relates to a system configured to support and organize one or more articles of exercise equipment, such as an exercise ball.

Background

The current gymnasium (gym) environment includes a variety of exercise equipment and accessories. In addition to free weights and weight machines, gym equipment and accessories such as Swiss/exercise/physio balls, exercise bands, foam rolls, yoga mats, abdominal wheels (ab wheels), the Pilates Wheel®, and so on can be found in gyms and fitness centers. With the variety of exercise equipment and accessories available, managing, organizing and storing all the different pieces of equipment is important during routine operations of a fitness facility.

Some exercise storage and organization equipment is available in the marketplace, but is frequently limited with respect to space efficiency, storage capacity and aesthetic appeal. Multi-purpose fitness storage racks are most often large floor units that attempt to store all fitness equipment. Such storage racks can take up significant floor space. These units frequently appeal to fitness environments that have ample room to dedicate floor space to such storage solutions. In smaller space settings of fitness studios where floor space is limited, a more space efficient storage solution is required. The current marketplace fails to offer such a storage solution.

Many traditional storage systems that store Physio-Balls (Swiss Balls/exercise balls) stack the multiple balls on top of each other. Such a storage system does not allow the user to access any one of the lower balls without breaking down the column of stacked balls. Other systems that store Physio-Balls (Swiss Balls) individually and vertically are often part of a larger multi-purpose storage unit that is bulky and takes up considerable floor space.

Other storage solutions that are not floor space-dependent are inefficient in requiring individual mounts per stored item, and lack the versatility to accommodate a variety of different types of fitness equipment all in one place such as Physio-Balls (Swiss Balls), yoga mats and blocks, ab wheels, foam rolls, ball hand pumps, exercise bands, balance pads, and similar accessories, all at the same time, in one convenient and space efficient location that does not take up valuable floor space.

The aesthetic consideration of any storage solution can be a significant need the consumer may want to satisfy when purchasing their fitness storage solution. Unfortunately, the current market of fitness storage solutions fails to adequately address this issue. Most exercise storage solutions are aesthetically deficient and fail to offer the consumer an exercise and fitness storage solution that is space efficient, versatile, has ample storage capacity, and is aesthetically complimentary with the environment it will serve.

SUMMARY

Aspects of the invention are directed to a system for organizing and supporting one or more articles of gymnasium/fitness equipment or accessories. One aspect includes a base plate with two elongated bars attached to the base plate. The base plate may be configured to be rigidly mounted to a rigid vertical attachment surface such as a wall or a support stand. The first and second elongated bars may each have a first end rigidly attached to the base plate at a first position and a second position, respectively. A first line joining the first position and the second position may be approximately parallel to a horizontal axis referenced to the earth's surface.

In one aspect, the first elongated bar and the second elongated bar project outwards relative to the base plate from the first position and the second position. A second line joining a second end of the first elongated bar and a second end of the second elongated bar may be approximately parallel to the first line. The second end of each of the first and second elongated bar may be at a higher elevation as compared to the respective first end of each of the first and second elongated bar. A substantially rigid structure comprised of the vertical attachment surface, the base plate, the first elongated bar, and the second elongated bar is configured to support an exercise ball. Additional attachments to the ball perch system can be used to support and store other types of fitness equipment and/or fitness accessories.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified.

DETAILED DESCRIPTION

Figure 1A:
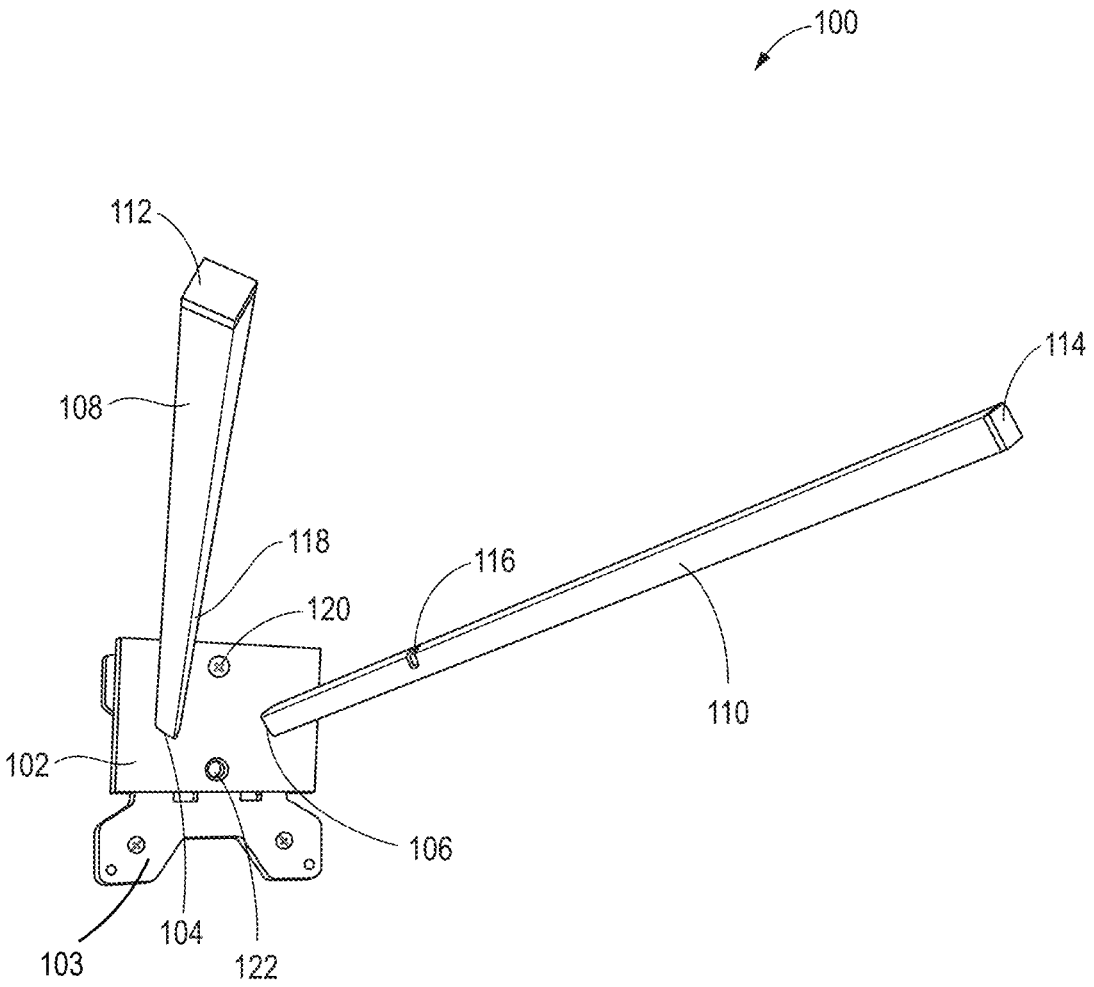
FIG. 1A is a pictorial drawing depicting a ball perch.

In the following description, reference is made to the accompanying drawings that form a part thereof, and in which is shown by way of illustration specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Embodiments in accordance with the present disclosure may be embodied as an apparatus, method, or computer program product. Accordingly, the present disclosure may take the form of an entirely hardware-comprised embodiment, an entirely software-comprised embodiment (including firmware, resident software, micro-code, etc.), or an embodiment combining software and hardware aspects that may all generally be referred to herein as a "circuit," "module," or "system." Furthermore, embodiments of the present disclosure may take the form of a computer program product embodied in any tangible medium of expression having computer-usable program code embodied in the medium.

Any combination of one or more computer-usable or computer-readable media may be utilized. For example, a computer-readable medium may include one or more of a portable computer diskette, a hard disk, a random-access memory (RAM) device, a read-only memory (ROM) device, an erasable programmable read-only memory (EPROM or Flash memory) device, a portable compact disc read-only memory (CDROM), an optical storage device, a magnetic storage device, and any other storage medium now known or hereafter discovered. Computer program code for carrying out operations of the present disclosure may be written in any combination of one or more programming languages. Such code may be compiled from source code to computer-readable assembly language or machine code suitable for the device or computer on which the code can be executed.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction and then scaled accordingly. A cloud model can be composed of various characteristics (e.g., on-demand self-service, broad network access, resource pooling, rapid elasticity, and measured service), service models (e.g., Software as a Service ("SaaS"), Platform as a Service ("PaaS"), and Infrastructure as a Service ("IaaS")), and deployment models (e.g., private cloud, community cloud, public cloud, and hybrid cloud).

The flow diagrams and block diagrams in the attached figures illustrate the architecture, functionality, and operation of possible implementations of systems, methods, and computer program products according to various embodiments of the present disclosure. In this regard, each block in the flow diagrams or block diagrams may represent a module, segment, or portion of code, which includes one or more executable instructions for implementing the specified logical function(s). It is also noted that each block of the block diagrams and/or flow diagrams, and combinations of blocks in the block diagrams and/or flow diagrams, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flow diagram and/or block diagram block or blocks.

Aspects of the invention described herein are configured to provide a support and organization system for gym/fitness equipment such as exercise balls, exercise bands, foam rolls, yoga mats, abdominal wheels, and so on. The ball perch system described herein is mountable on a wall or on a support stand, and can provide support and organization for multiple items of fitness equipment.

The ball perch system is a sports and exercise storage solution that addresses three major deficiencies in the current marketplace: Most exercise storage solutions are not space efficient; these storage solutions take up too much floor space. Most lack compact versatility. They lack the capacity to store a variety of equipment and accessories in a compact design and most lack the capacity to store multiple items at once without taking up valuable floor space. For example, storing a single basketball on a wall mount is a limited storage solution.

The fourth deficiency is the aesthetic limitations of the current storage solution offerings. Most are drab and outdated-looking due to their design style and the materials they are constructed with, making them unattractive and aesthetically unfit to complement many interior decor settings.

The ball perch is a wall-mounted storage solution that is space efficient, requires minimal space to install, and does not take up any floor space. Due to its compact design, it can be used in large or small spaces. The ball perch system is able to accommodate the simultaneous storage of a variety of different types of exercise accessories while taking up minimal wall space and no floor space. The ball perch system (also referred to herein as "Ball Perch System") has a minimalist modern design that is aesthetically compatible with and complimentary in many settings.

FIG. 1A is a pictorial drawing depicting ball perch 100. As depicted, ball perch 100 includes base plate 102, mechanical mounting plate 103, bar attachment points 104 and 106, elongated bar 108, elongated bar 110, and wall mount holes 120 and 122. Elongated bar 108 and elongated bar 110 include notch 118 and notch 116, respectively. Elongated bar 108 and elongated bar 110 also include accessory insert hole 112 and accessory insert hole 114, respectively, at their respective terminal ends.

In an aspect, base plate 102 may mounted on a rigid vertical surface such as a wall (or some other kind of vertical rigid support) via wall mount holes 120 and 122, and via mechanical mounting plate 103. In an aspect, screw mounting is used to secure (i.e., fasten) base plate 102 to the rigid vertical surface. Elongated bar 108 and elongated bar 110 may be rigidly connected to base plate 102 at bar attachment points 104 and 106, respectively. An imaginary line joining bar attachment points 104 and 106 may be substantially parallel to the earth's surface referenced to a local coordinate system. In an aspect, elongated bar 108 and elongated bar 110 are of approximately the same dimensions (e.g., length and thickness). In some aspects, ball perch 100 is mounted directly on the rigid vertical surface, without the use of mechanical mounting plate 103.

In an aspect, accessory insert holes 112 and 114 may be used to physically connect with one or more accessories for the ball perch system, as described herein. (As depicted in FIG. 1A, accessory insert holes 112 and 114 are covered with removeable covering caps that can be removed when attaching an accessory, and reattached when the accessory is removed; accessory insert holes 112 and 114 with the removeable covering caps removed are depicted subsequently.) Notch 118 and 116 may be used to support one or more accessories for the ball perch system, as described herein.

In an aspect, the terminal end of elongated bar 108 is at a higher elevation than the end of elongated bar 108 that is connected to base plate 102 at bar attachment point 104. The terminal end of elongated bar 110 may be at a higher elevation than the end of elongated bar 110 that is connected to base plate 102 at bar attachment point 106. An imaginary line joining the terminal end of elongated bar 108 and the terminal end of elongated bar 110 may be longer than, and substantially parallel to, the imaginary line joining bar attachment points 104 and 106. Collectively, base plate 102, elongated bar 108, and elongated bar 110 form a rigid structure that is configured to support an article of exercise equipment such as an exercise ball.

In a specific embodiment, the distance between bar attachment points 104 and 106 is approximately 2.5 inches. Each of elongated bars 108 and 110 may be approximately 16 inches in length. The distance between the terminal ends of elongated bars 108 and 110 may be approximately 9 inches. The terminal end of elongated bar 108 may be at a 5% elevation with respect to the end of elongated bar 108 that is connected to base plate 102 at bar attachment point 104. The terminal end of elongated bar 110 may be at a 5% elevation with respect to the end of elongated bar 110 that is connected to base plate 102 at bar attachment point 106.

In one aspect, the ball perch 100 and base plate 102 are attached to drywall (of ½" or ⅝" thickness) with a ¼" heavy duty drywall toggle anchor that has a shear rating between 120-250 lbs. respectively to the drywall thickness. This rating reduces any chances of attachment failure of the Ball Perch System to the wall caused due to customer abuse or excessive weight being placed on the Ball Perch System.

As depicted, elongated bars 108 and 110 are attached to base plate 102 such that a support surface for an exercise ball provided by each of bar 108 and 110 is inclined at an angle with respect to a horizontal surface. This inclination offers a larger surface area and correspondingly better support for an exercise ball.

Embodiments of ball perch 100 and other accessories described herein may be constructed from any combination of materials that can be formed into rigid structures. Examples of such materials include plastics and metals such as aluminum and stainless steel. Some embodiments of ball perch 100 may include portions that are constructed from materials such as carbon fiber.

The ball perch system is designed to be a modular system, with configurable and changeable components that can be used to reconfigure ball perch 100 in different ways. The ball perch system comprises ball perch 100, along with different accessories that can be connected/attached to ball perch 100, as described herein. These accessories can be configured to support a variety of gym/fitness equipment or accessories.

Figure 1B:
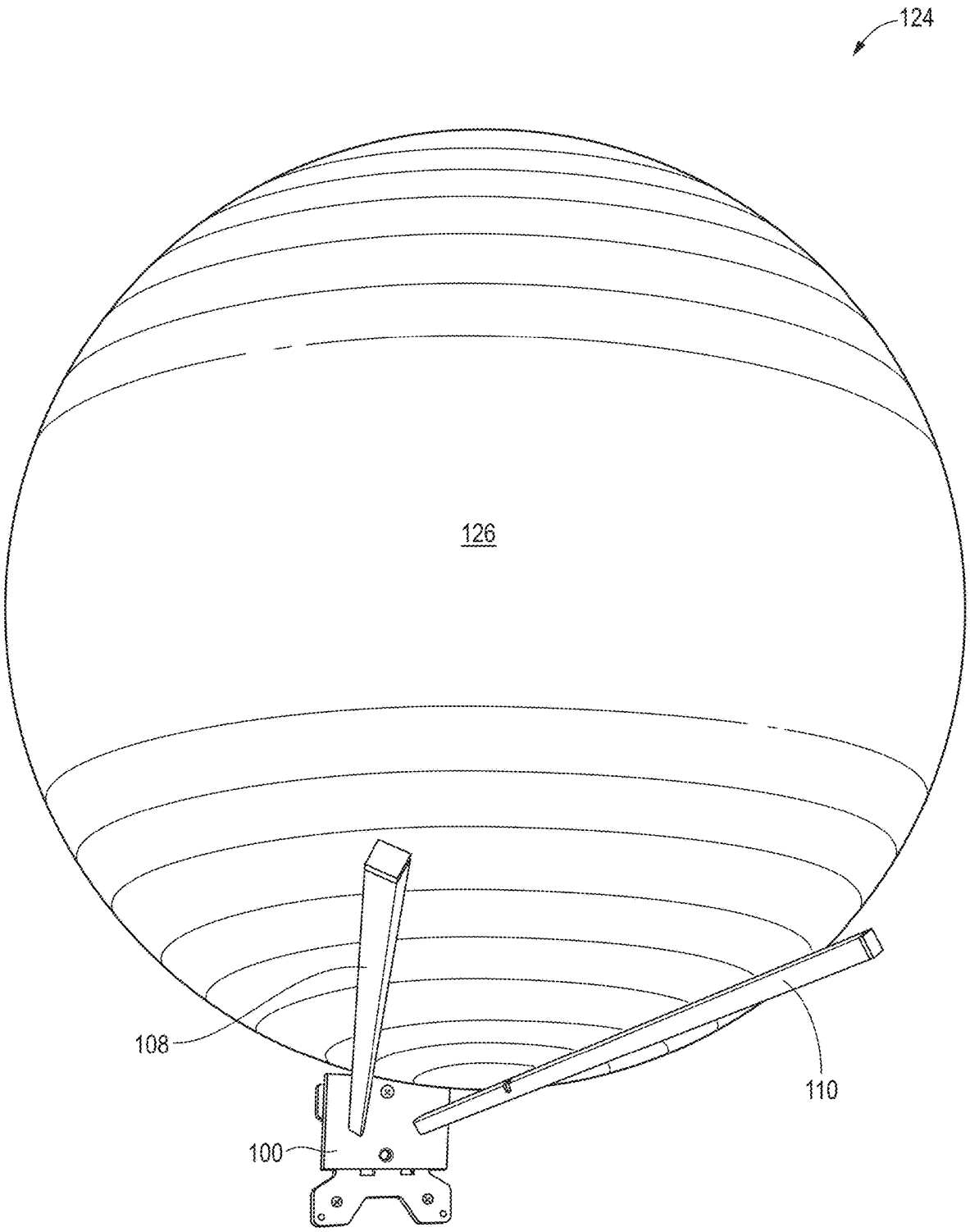
FIG. 1B is a pictorial drawing depicting a view of a ball perch supporting an exercise ball.

FIG. 1B is a pictorial drawing depicting a view 124 of ball perch 100 supporting exercise ball 126. As depicted in FIG. 1B, exercise ball 126 is supported by elongated bars 108 and 110, where exercise ball 126 makes contact with elongated bars 108 and 110 at respective contact points/areas (two contact points or areas). Due to the incline of each of elongated bars 108 and 110 caused by the elevation of their respective terminal ends with respect to the respective ends that are attached to base plate 102, exercise ball 126 tends to roll towards base plate 102 and the associated rigid vertical attachment surface due to gravity, where it is supported by a third contact point/area on the rigid vertical attachment surface, as depicted in FIG. 1B. In this way, a substantially rigid structure comprised of the vertical attachment surface, base plate 102, elongated bar 108, and elongated bar 110 is configured to support exercise ball 126. In an aspect, the term "exercise ball" is used interchangeably with terms such as "Swiss Ball" and/or "Physio Ball".

In an aspect, one or more accessories can be hung (or supported) by elongated bars 108 and 110 on ball perch 100. Examples of fitness equipment or fitness accessories that can be hung on/from any combination of elongated bars 108 and 110 include but are not limited to jump (skipping) ropes, exercise bands, and so on. Elongated bars 108 and 110 may also be used to support exercise/fitness accessories such as foam rolls and rolled-up yoga mats. Simultaneously, while the hung accessories support the articles of fitness equipment, ball perch 100 can support exercise ball 126.

Figure 2:
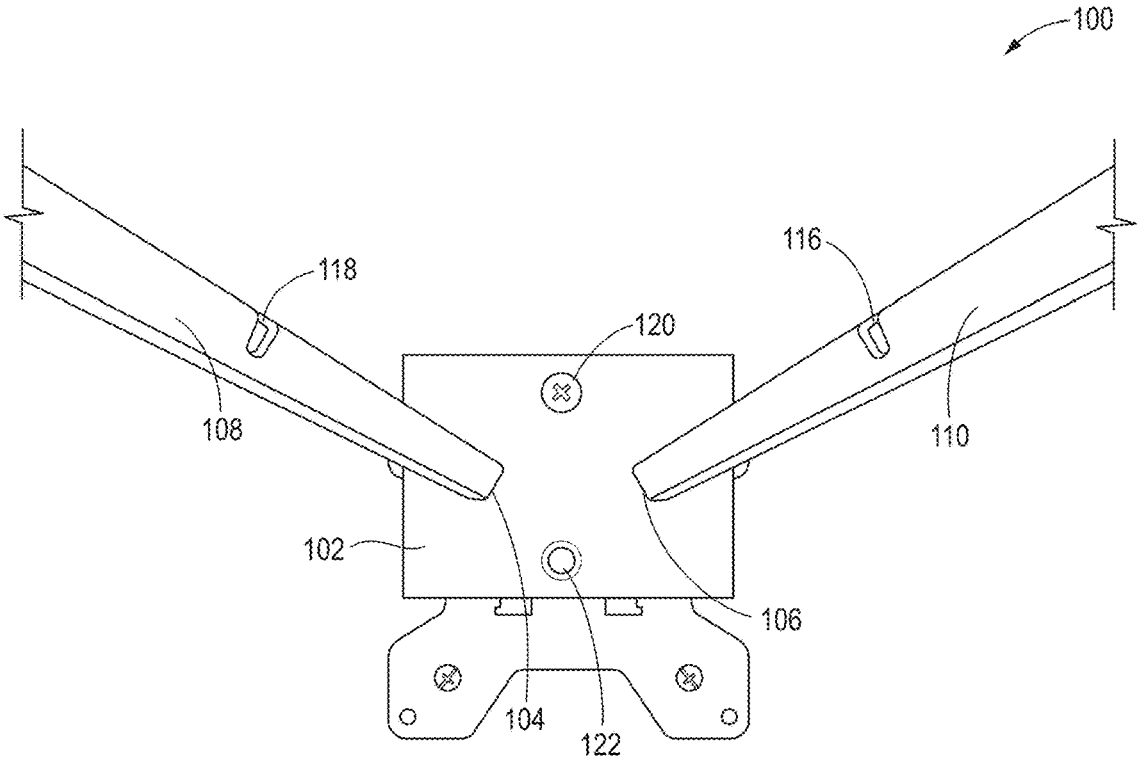
FIG. 2 is a pictorial drawing depicting a view of a portion of the ball perch.

FIG. 2 is a pictorial drawing depicting a view of a portion of ball perch 100. FIG. 2 presents a frontal close-up view of ball perch 100. FIG. 2 depicts base plate 102, bar attachment points 104 and 106, elongated bar 108, elongated bar 110, and wall mount holes 120 and 122. Notch 116 and notch 118 are also depicted. FIG. 2 depicts a screw being used with wall mount hole 120, to secure base plate 102 (and hence, ball perch 100) to the vertical attachment surface.

In an aspect, wall mount holes 120 and 122 on the base plate 120 are used to secure ball perch 100 to a wall or to any other rigid vertical surface. In one aspect, ball perch 100 is attached to a wall by using two 3" screws and two 75 lb. screw in drywall anchors at either a framing stud and without the use of the two anchors, or directly to drywall with the use of the two anchors.

Figure 3:
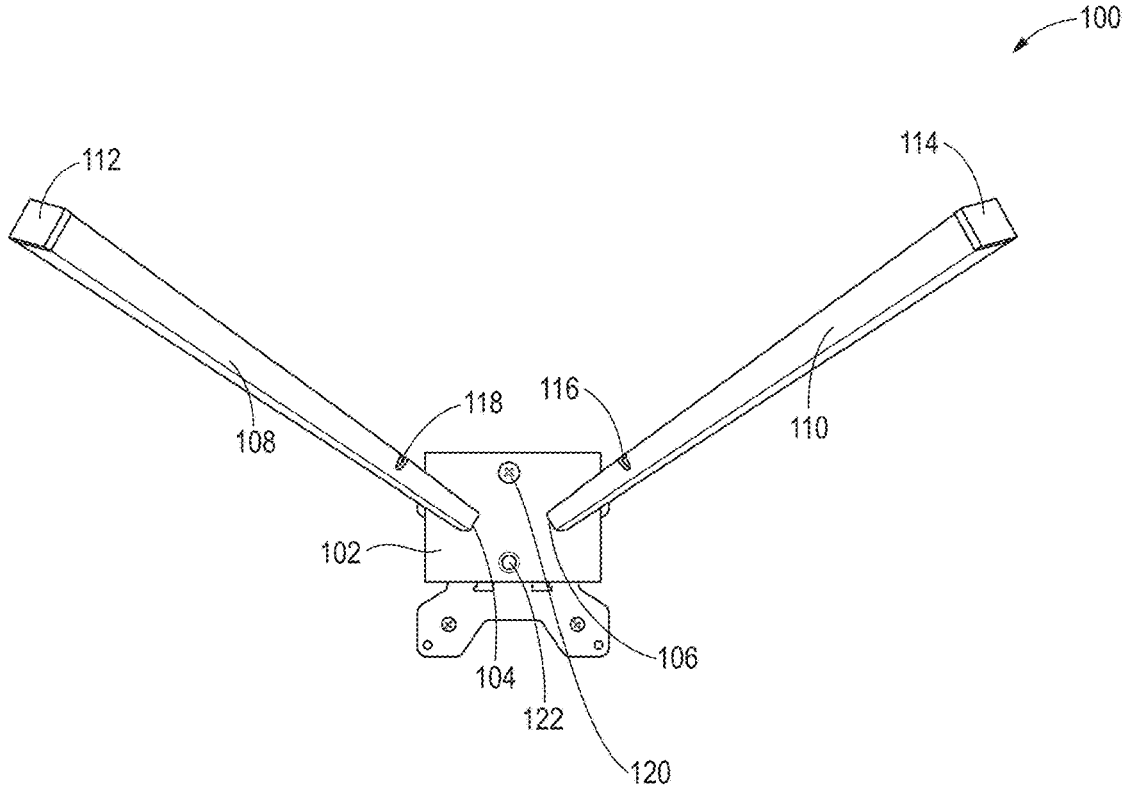
FIG. 3 is a pictorial drawing depicting the ball perch.

FIG. 3 is a pictorial drawing depicting ball perch 100. FIG. 3 presents a frontal view of ball perch 100; FIG. 2 is a close-up view of the view presented in FIG. 3. FIG. 3 depicts base plate 102, bar attachment points 104 and 106, elongated bar 108, elongated bar 110, and wall mount holes 120 and 122. Notch 116 and notch 118 are also depicted, along with accessory insert holes 112 and 114 (covered with removable covering caps).

Figure 4:
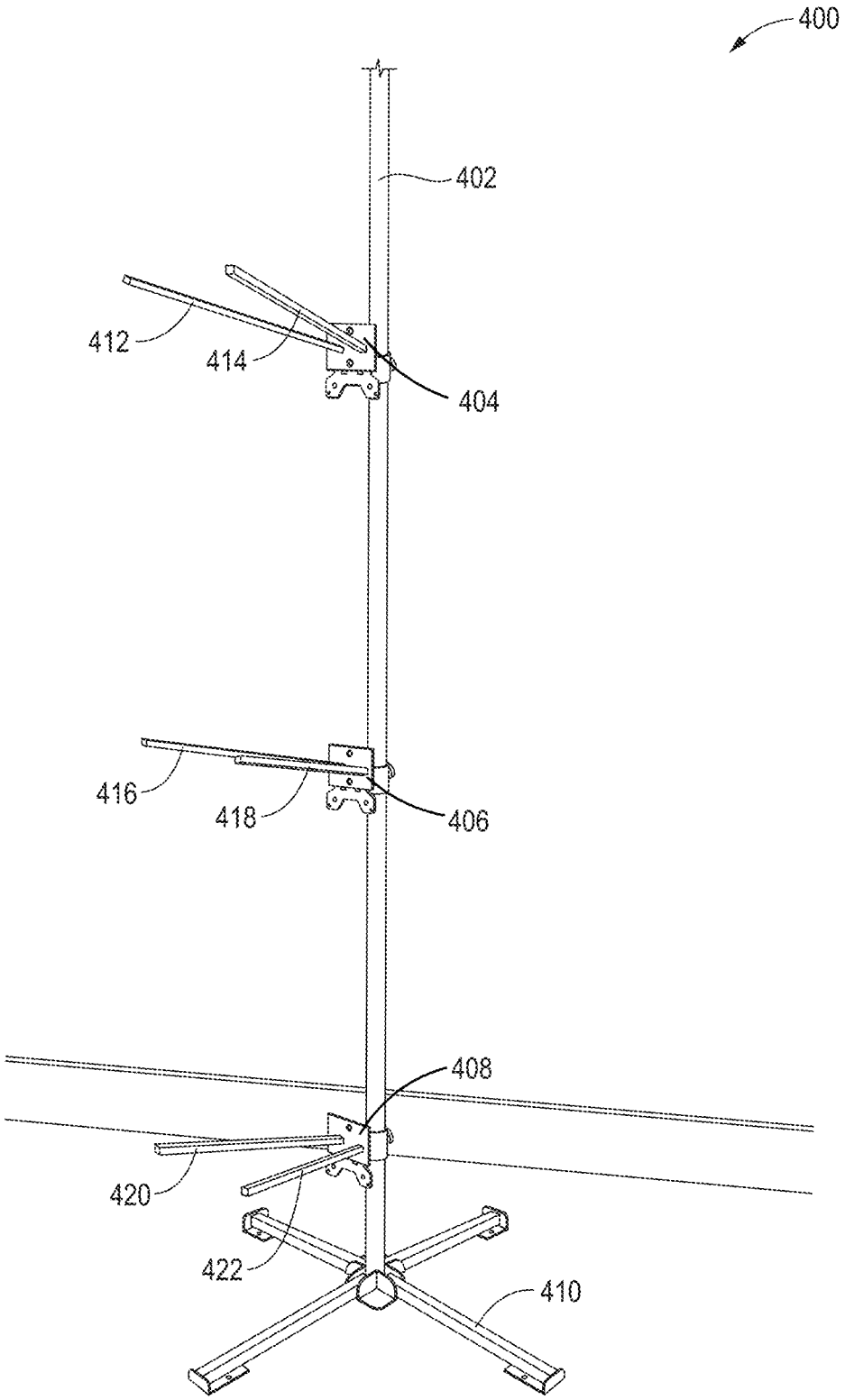
FIG. 4 is a pictorial drawing depicting a view of multiple ball perches mounted on a vertical stand.

FIG. 4 is a pictorial drawing depicting a view 400 of multiple ball perches mounted on a vertical stand. This arrangement may be referred to as a "Ball Perch Tree". As depicted, view 400 depicts vertical stand 402, with support base 410. A first ball perch that includes base plate 404, elongated bar 412 and elongated bar 414 is shown to be rigidly attached to vertical stand 402 via base plate 404. A second ball perch that includes base plate 406, elongated bar 416 and elongated bar 418 is shown to be rigidly attached to vertical stand 402 via base plate 406, stacked vertically below the first ball perch. A third ball perch that includes base plate 408, elongated bar 420 and elongated bar 422 is shown to be rigidly attached to vertical stand 402 via base plate 408, stacked vertically below the second ball perch. Vertical stand 402 acts as a rigid vertical attachments for the three ball perches. Support base 410 supports a combination of vertical stand 402, and the three ball perches depicted in FIG. 4.

In the embodiment presented in view 400, vertical stand 402 provides a rigid vertical support for the three ball perches, that are physically connected to vertical stand 402 in a vertically-stacked arrangement. Each ball perch may be configured to support an exercise ball, in a manner similar to ball perch 100. In this way, multiple ball perches can be stacked vertically on a single vertical support stand, and this configuration can be used to support multiple exercise balls. This can provide space savings and improved organizational capabilities to gym facilities and fitness centers. An area below the lowermost ball perch comprised of includes base plate 408, elongated bar 420 and elongated bar 422 may be used to store additional fitness equipment or accessories, such as another exercise ball, basketballs, volleyballs, soccer balls, foam rolls, rolled-up yoga mats, and so on.

Figure 5:
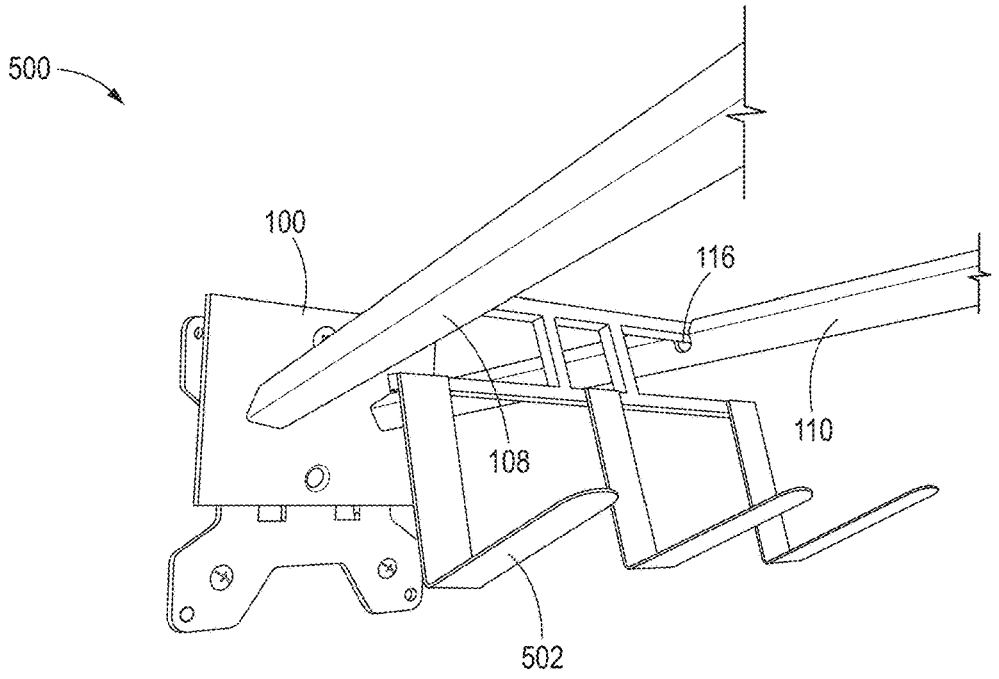
FIG. 5 is a pictorial drawing depicting a close-up view of the ball perch showing a rigid attachment attached to the ball perch.

FIG. 5 is a pictorial drawing depicting a close-up view 500 of ball perch 100 showing rigid attachment 502 attached to ball perch 100. In an aspect, a top bar associated with rigid attachment 502 is inserted into notch 116 and notch 118 (notch 118 is not depicted in FIG. 5), and is supported by a combination of elongated bars 108 and 110. As shown, rigid attachment 502 has three L-shaped extensions, from which one or more articles of fitness equipment or fitness accessories can be hung. In general, ball perch 100 supports rigid attachment 502 inserted into notches 116 and 118 as a part of the Ball Perch System, and also indirectly supports any articles of fitness equipment or fitness accessories that can be hung on/from rigid attachment 502. Examples of fitness equipment or fitness accessories that can be hung on/from rigid attachment 502 include but are not limited to (skipping) ropes, exercise bands, and so on. In an aspect, an exercise ball, such as exercise ball 126, can be supported on ball perch 100 as described earlier, even when rigid attachment 502 is installed. This enables a greater storage and organizational capability for the Ball Perch System.

Figure 6:
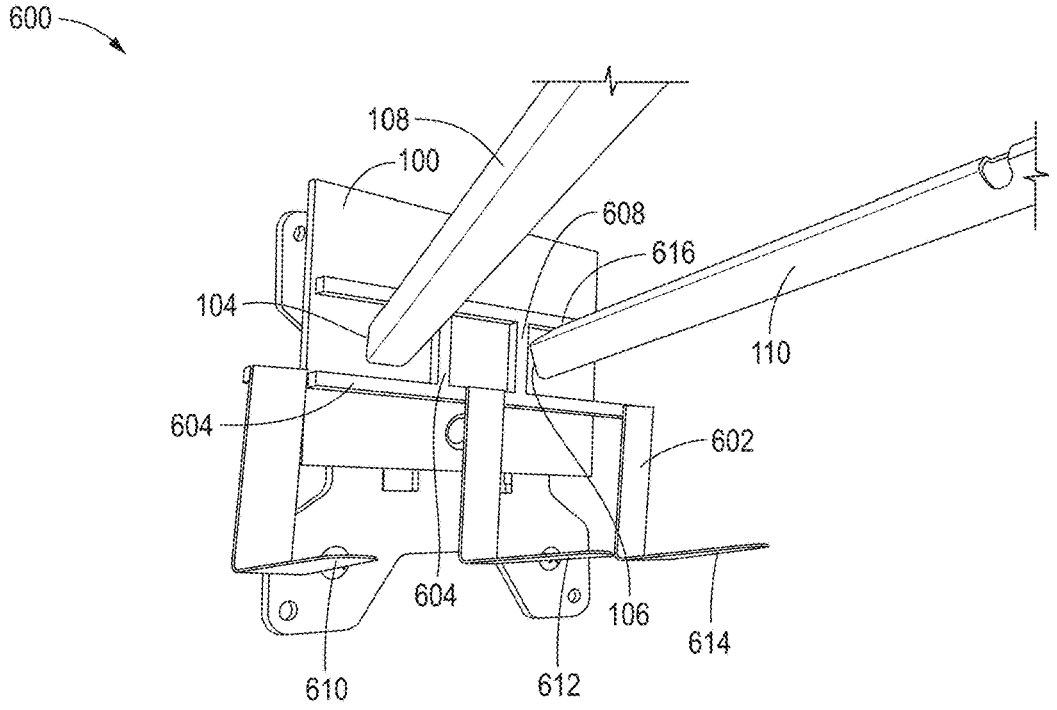
FIG. 6 is a pictorial drawing depicting a close-up view of the ball perch showing a rigid attachment attached to the ball perch.

FIG. 6 is a pictorial drawing depicting a close-up view 600 of ball perch 100 showing a rigid attachment 602 attached to ball perch 100. In an aspect, rigid attachment 602 is essentially similar to rigid attachment 502. In view 600, top bar 616 associated with rigid attachment 602 is supported on a combination of elongated bar 108 and elongated bar 110, at bar attachment point 104, and bar attachment point 106, respectively. Top bar 616 is connected to bar 604 of rigid attachment 602 by cross beams 606 and 608.

As shown, rigid attachment 602 has three L-shaped extensions connected to bar 604—extension 610, extension 612, and extension 614. One or more articles of fitness equipment or fitness accessories can be hung on any combination of these three L-shaped extensions. In general, ball perch 100 supports rigid attachment 602 supported on a combination of elongated bar 108 and elongated bar 110, at bar attachment point 104, and bar attachment point 106, respectively and also indirectly supports any articles of fitness equipment or fitness accessories that can be hung on/from rigid attachment 602. Examples of fitness equipment or fitness accessories that can be hung on/from rigid attachment 602 include but are not limited to jump (skipping) ropes, exercise bands, and so on. In an aspect, an exercise ball, such as exercise ball 126, can be supported on ball perch 100 as described earlier, even when rigid attachment 602 is installed. Collectively, ball perch 100 and rigid attachment 602 can be used to support and organize a variety of gym/fitness equipment and accessories.

Figure 7:
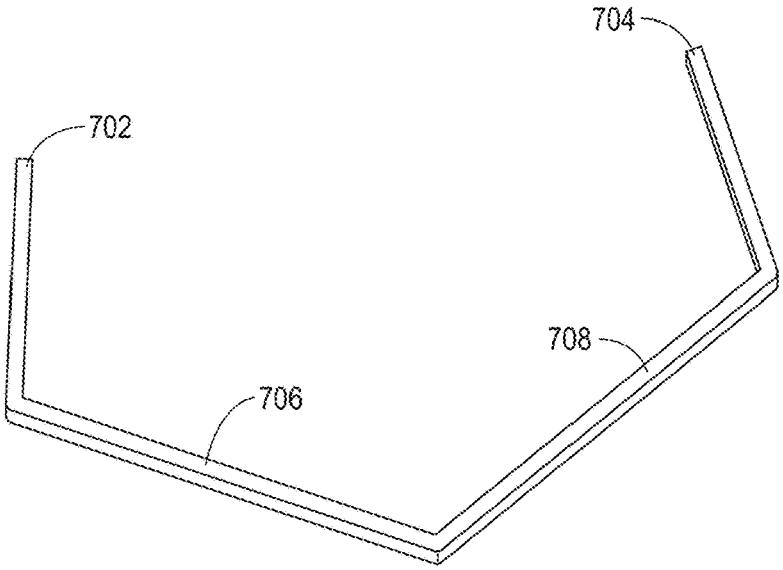
FIG. 7 is a pictorial drawing depicting a support attachment.

FIG. 7 is a pictorial drawing depicting support attachment 700. As depicted, support attachment 700 is a rigid structure comprised of four coplanar rods—rod 702, rod 704, rod 706, and rod 708—joined end-to-end, with each joint further comprising an angle. In an aspect, an end of rod 702 is connected to an end of rod 706, an end of rod 706 is connected to an end of rod 708, and an end of rod 708 is connected to an end of rod 704. The other (unconnected) ends of rod 702 and rod 704 are left unconnected.

Support attachment may be used in conjunction with ball perch 100 to provide further support to exercise ball 126. Support attachment may also be used to provide support to different kinds of balls such as volleyballs, basketballs, footballs, etc. In an aspect, support attachment 700 may be constructed from any combination of materials that can be formed into rigid structures. Examples of such materials include plastics and metals such as aluminum and stainless steel. Some embodiments of support attachment 700 may include portions that are constructed from materials such as carbon fiber.

In one aspect, the material used is square solid iron metal tubing for constructing one or more components of the Ball Perch system, selected for its strength and aesthetic contribution. The square tubing of the Ball Perch beams (0.5" square 'hollow' tubing—i.e., elongated bars 108 and 110) and all other components (5/16' solid core square metal pieces—i.e., any support and accessory attachments described herein) may be selected for structurally and aesthetic reasons. In one aspect, these components can be made of other materials, but the square characteristic may be preserved. One embodiment uses iron to implement certain components of the Ball Perch System, due to reasonable production costs and room for sufficient retailer mark-up of wholesale production cost.

Furthermore, even the angles at which the square cross sections of elongated bars 108 and 110 are angled on elongated bars 108 and 110 serves the functional purpose of resting the flat side of each beam against the resting Swiss Ball, maximizing surface contact between the beams and the ball, for a more secure placement and adherence, as depicted in FIGS. 1A and 1B.

Figure 8:
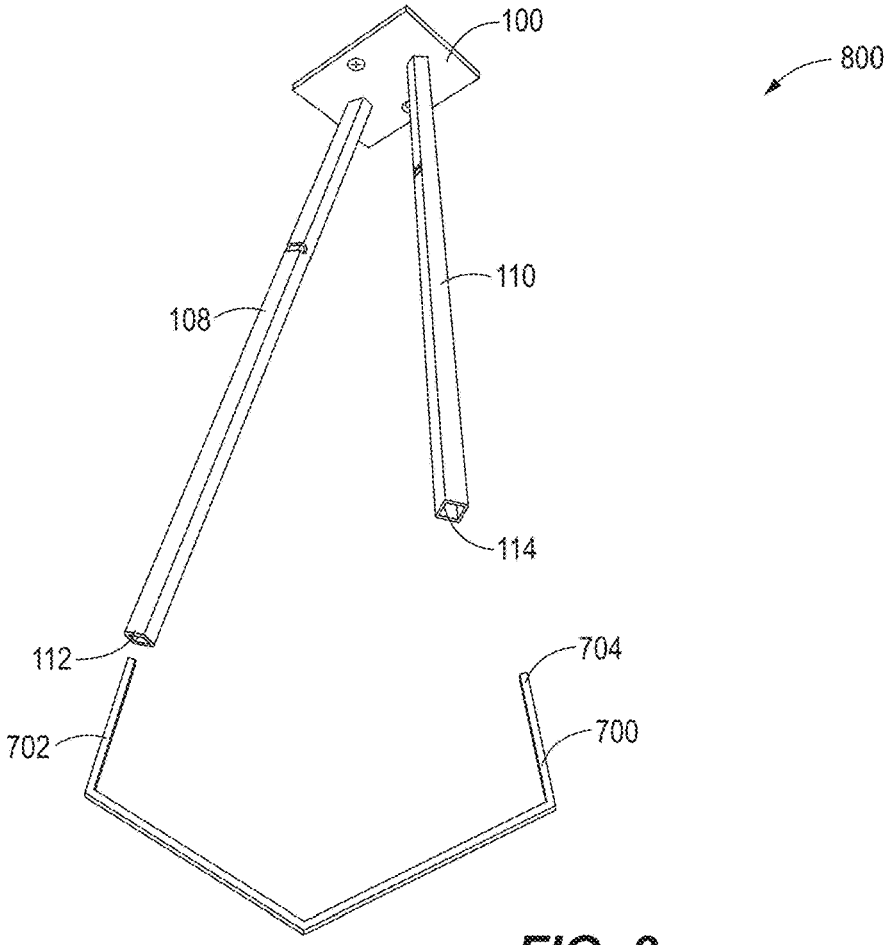
FIG. 8 is a pictorial drawing depicting a view of a support attachment in a process of being connected to a ball perch.

FIG. 8 is a pictorial drawing depicting a view 800 of support attachment 700 in a process of being connected to a ball perch 100. As depicted, the unconnected ends of rod 702 and rod 704 of support attachment 700 are configured to be inserted into accessory insert holes 112 and 114 (shown with covering caps removed and accessory insert holes 112 and 114 exposed), of elongated bars 108 and 110, respectively.

Figure 9:
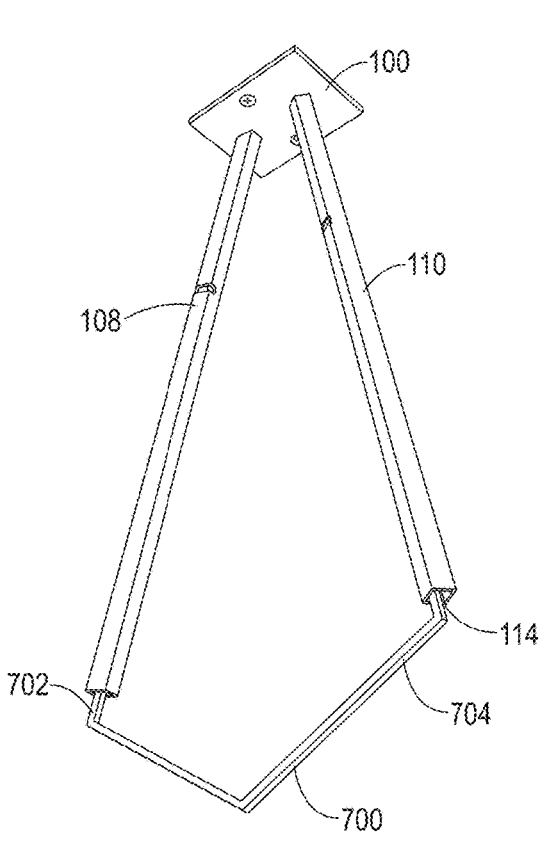
FIG. 9 is a pictorial drawing depicting a view of a support attachment connected to the ball perch.

FIG. 9 is a pictorial drawing depicting a view 900 of support attachment 700 connected to ball perch 100. Based on FIG. 8, when the unconnected ends of rod 702 and rod 704 of support attachment 700 are inserted into accessory insert holes 112 and 114, of elongated bars 108 and 110, respectively, a combination of ball perch 100 and support attachment 700 forms a rigid support structure for exercise ball 126. Specifically, support attachment 700 is configured to prevent exercise ball 126, or any other ball supported by support attachment 700 and ball perch 100, from rolling off the exposed ends of elongated bars 108 and 110, respectively.

Figure 10:
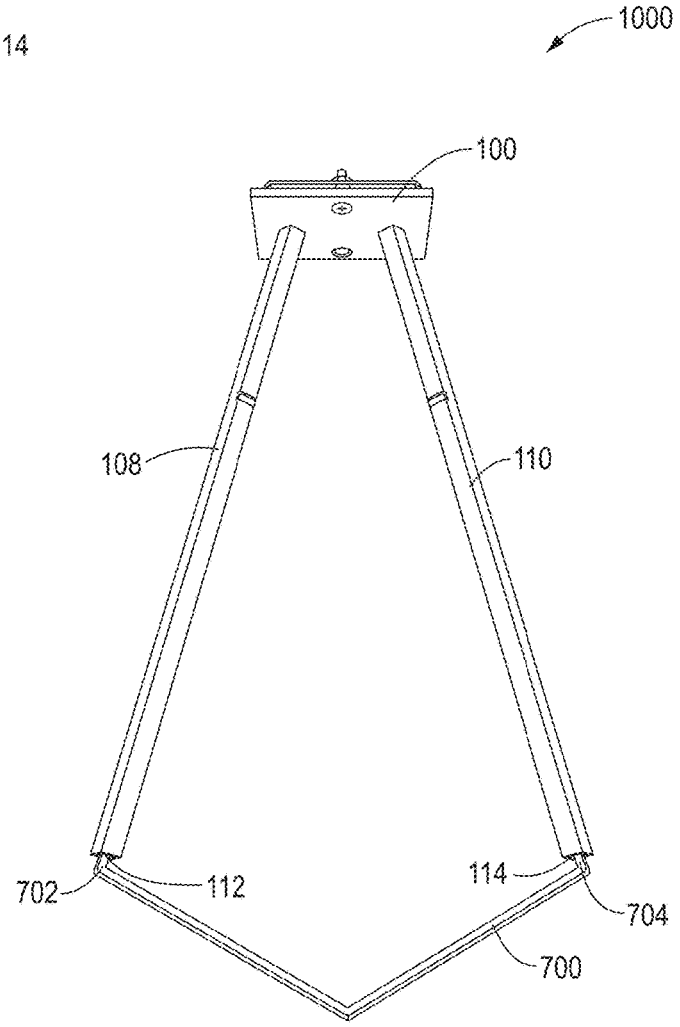
FIG. 10 is a pictorial drawing depicting a view of a support attachment connected to the ball perch.

FIG. 10 is a pictorial drawing depicting a view 1000 of support attachment 700 connected to ball perch 100. FIG. 10 presents an alternate view of the configuration of support attachment 700 connected to ball perch 100 as presented in FIG. 9.

Figure 11:
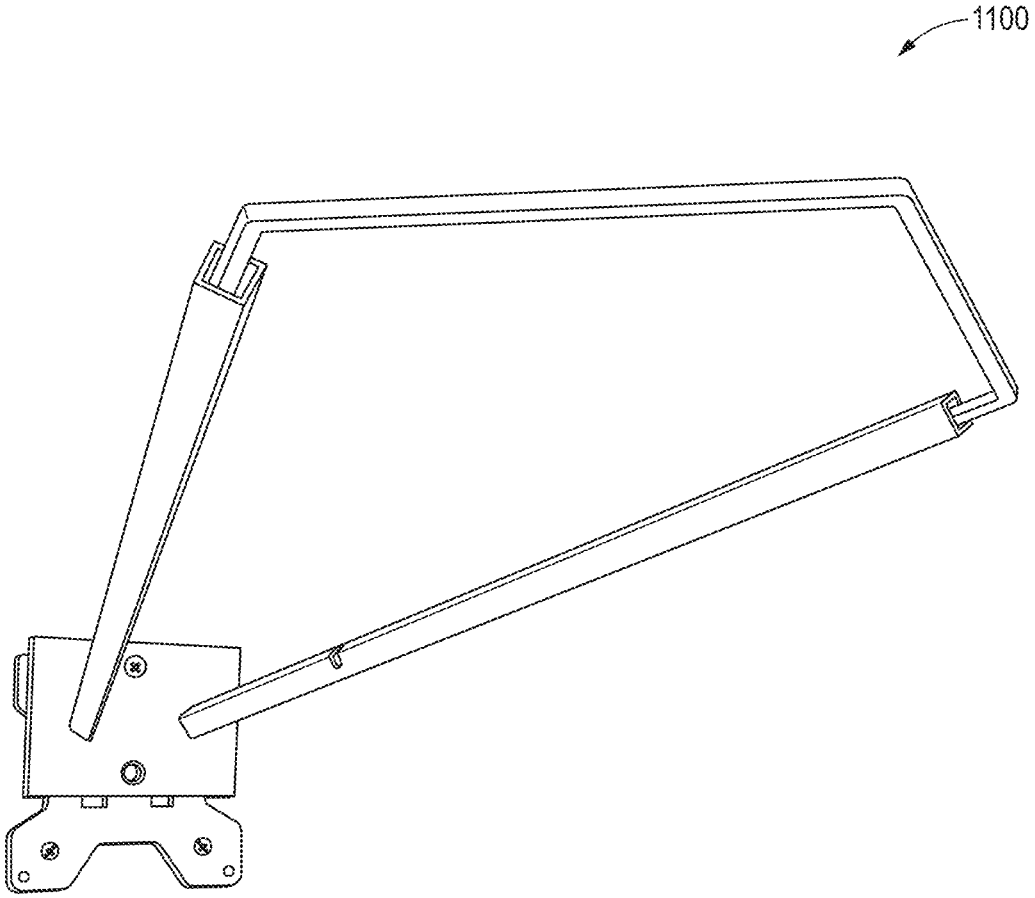
FIG. 11 is a pictorial drawing depicting a view of a support attachment connected to the ball perch, with the ball perch being mounted on a rigid vertical surface.

FIG. 11 is a pictorial drawing depicting a view 1100 of support attachment 700 connected to ball perch 100 (as presented in FIGS. 9 and 10), with ball perch 100 being mounted on a rigid vertical surface.

Figure 12:
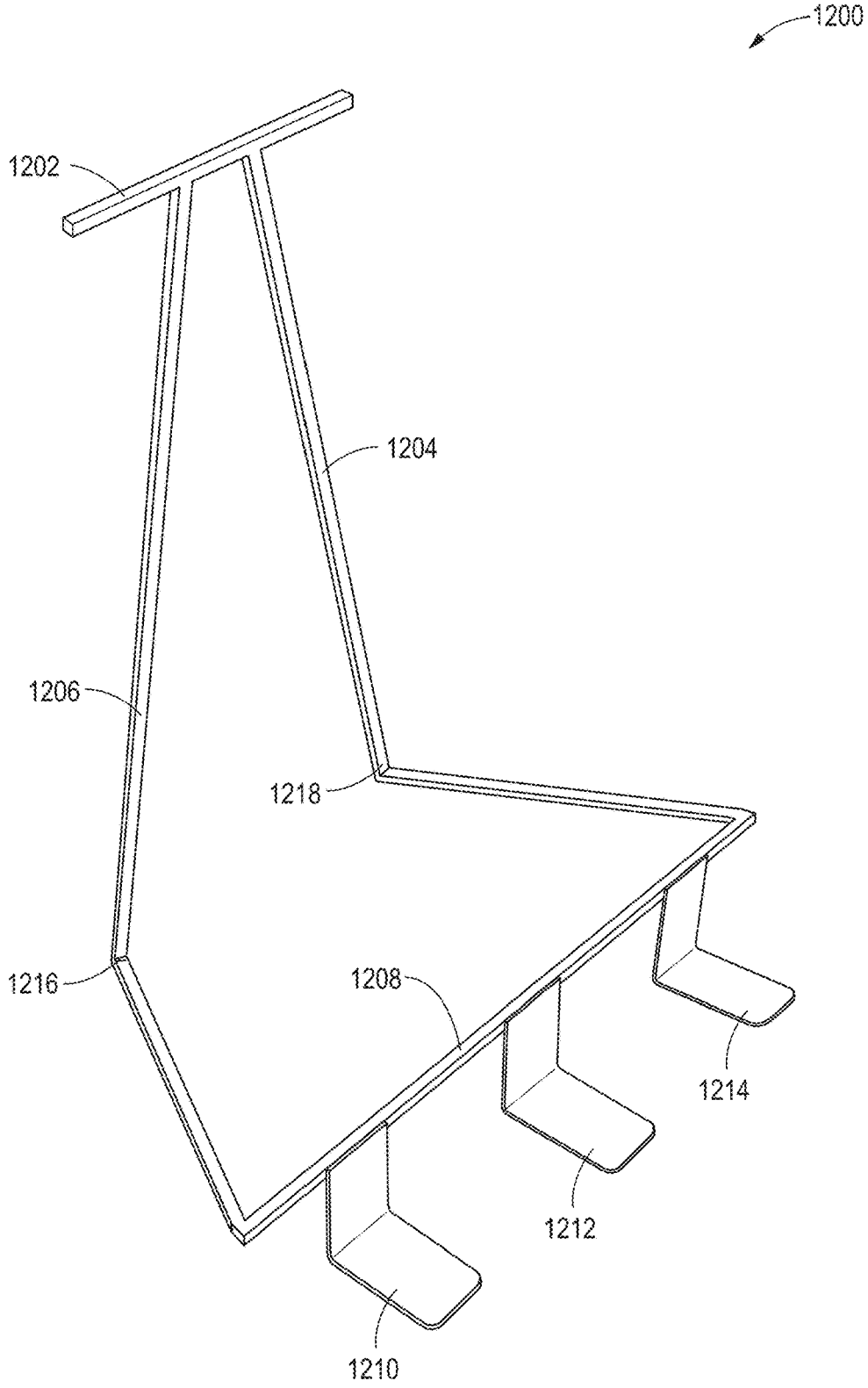
FIG. 12 is a pictorial drawing depicting an accessory attachment.

FIG. 12 is a pictorial drawing depicting accessory attachment 1200. As depicted, accessory attachment is a three-dimensional support structure that includes horizontal bar 1202, rigid bar 1204, rigid bar 1206, rigid structure 1208, L-shaped extension 1210, L-shaped extension 1212, and L-shaped extension 1214. In an aspect, rigid structure 1208 is a rigid structure comprised of three coplanar rods connected end-to-end, as depicted in FIG. 12. Rigid structure 1208 may be connected to rigid bars 1204 and 1206 to form an L-shaped structure. FIG. 12 depicts vertices 1216 and 1218 of angles formed between rigid bar 1206 and rigid structure 1208, and rigid bar 1204 and rigid structure 1208, respectively.

In an aspect, one or more articles of fitness equipment or fitness accessories can be hung on/from L-shaped extensions 1210 through 1214. Examples of fitness equipment or fitness accessories that can be hung on/from accessory attachment 1200 (i.e., L-shaped extensions 1210 through 1214) include but are not limited to TRX® suspension training components, jump (skipping) ropes, battle ropes, exercise bands, and so on.

In an aspect, accessory attachment 1200 is supported on ball perch 100 as a part of the Ball Perch System, where horizontal bar 1202 of accessory attachment 1200 is placed (e.g., hung) on elongated bar 108 and elongated bar 110, at bar attachment points 104 and 106. In this configuration, L-shaped extensions 1210 through 1214 can be used to support (e.g., hang) one or more articles of fitness equipment, in a manner similar to rigid attachment 502.

Figure 13:
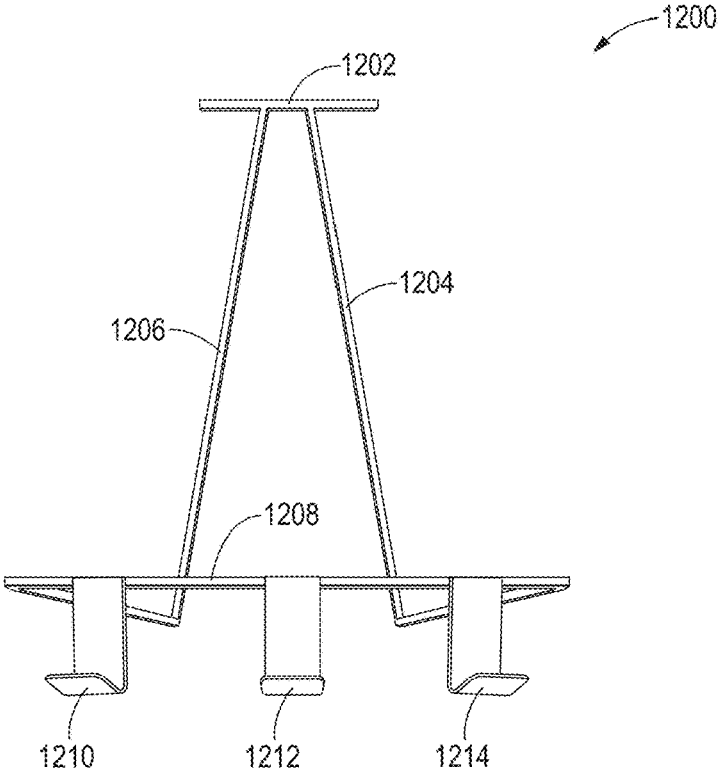
FIG. 13 is a pictorial drawing depicting an accessory attachment.

FIG. 13 is a pictorial drawing depicting accessory attachment 1200. FIG. 13 depicts an alternate (front) view of accessory attachment 1200, showing horizontal bar 1202, rigid bar 1204, rigid bar 1206, rigid structure 1208, L-shaped extension 1210, L-shaped extension 1212, and L-shaped extension 1214.

Figure 14:
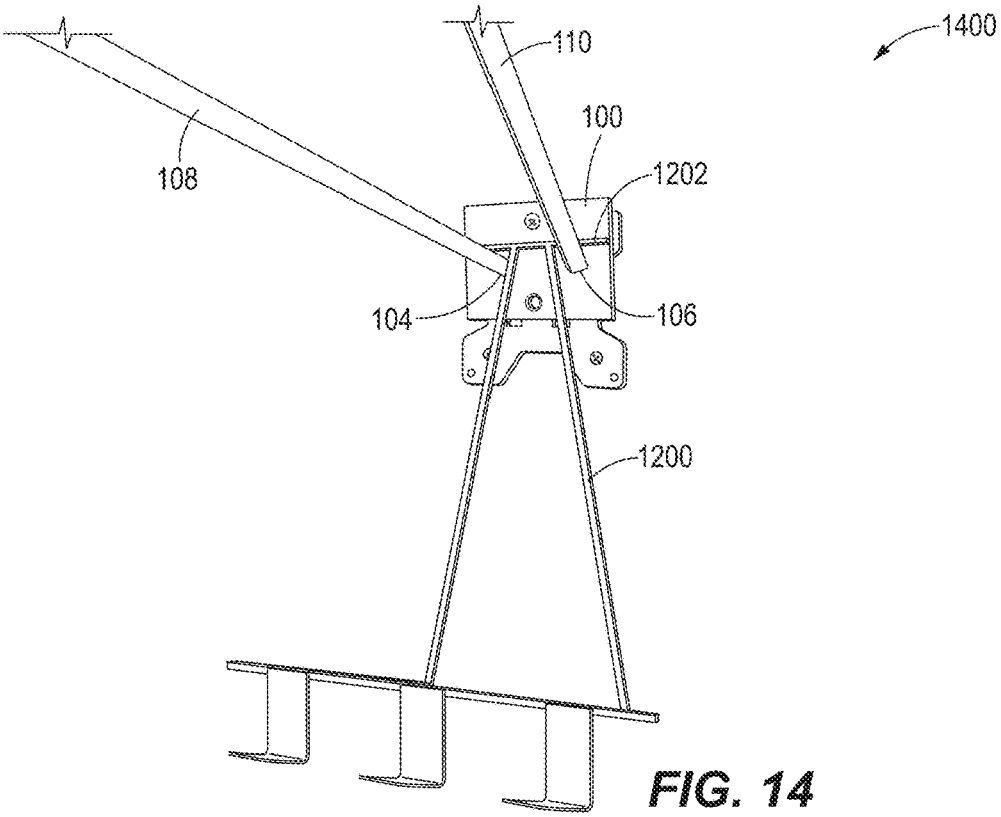
FIG. 14 is a pictorial drawing depicting a view of an accessory attachment mounted on a ball perch.

FIG. 14 is a pictorial drawing depicting a view 1400 of accessory attachment 1200 mounted on ball perch 100. As depicted in view 1400, accessory attachment 1200 is attached (e.g., hung from, or supported by) ball perch 100 by placing accessory attachment 1200 on ball perch 100 such that horizontal bar 1202 is supported by elongated bars 108 and 110, at bar attachment points 104 and 106, respectively. Ball perch 100 supports accessory attachment 1200, and any fitness accessories supported by accessory attachment 1200.

Figure 15:
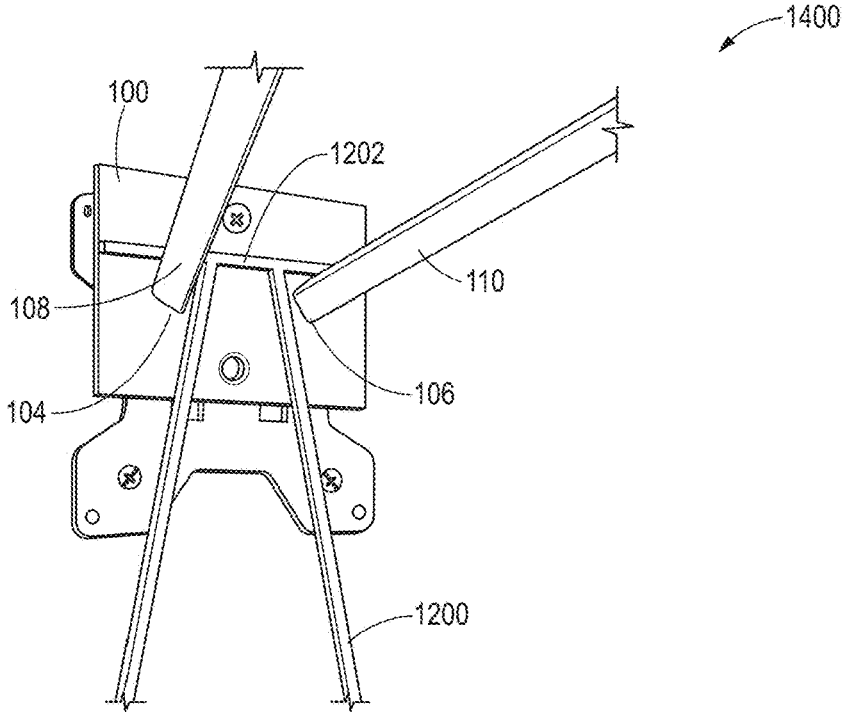
FIG. 15 is a pictorial drawing depicting a view of an accessory attachment attached to the ball perch.

FIG. 15 is a pictorial drawing depicting a view 1500 of accessory attachment 1200 attached to ball perch 100. View 1500 is a close-up view of the structure of accessory attachment 1200 mounted on ball perch 100 as presented in FIG. 14, from a different perspective. As depicted in view 1500, accessory attachment 1200 is attached (e.g., hung from, or supported by) ball perch 100 by placing accessory attachment 1200 on ball perch 100 such that horizontal bar 1202 is supported by elongated bars 108 and 110, at bar attachment points 104 and 106, respectively. Ball perch 100 supports accessory attachment 1200, and any fitness accessories supported by accessory attachment 1200. When accessory attachment 1200 is attached to ball perch 100, exercise ball 126 can be supported by ball perch 100, as described previously.

Figure 16:
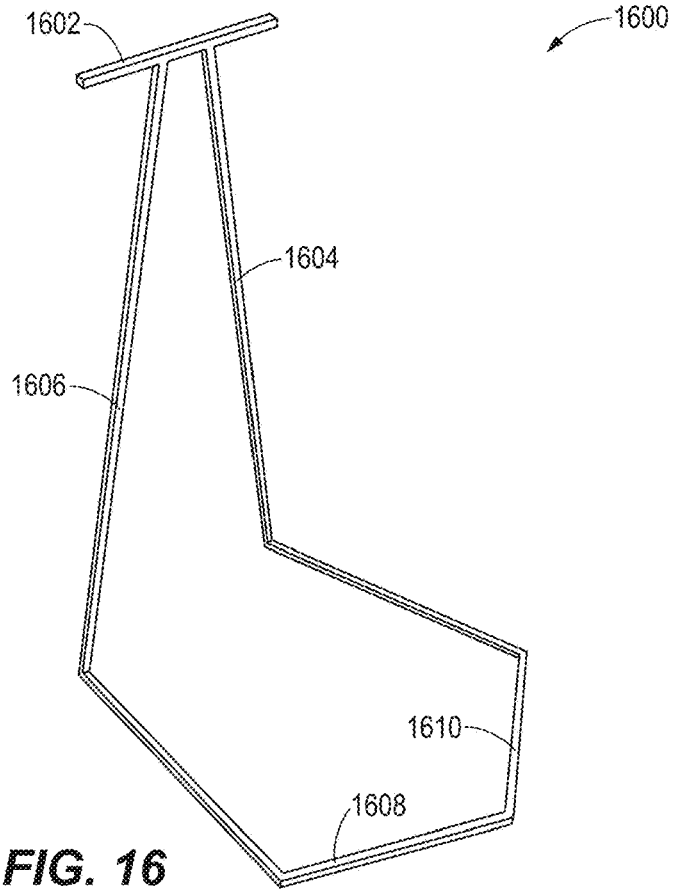
FIG. 16 is a pictorial drawing depicting an accessory attachment.

FIG. 16 is a pictorial drawing depicting accessory attachment 1600. As depicted, accessory attachment 1600 includes horizontal bar 1602, L-shaped bars 1604 and 1606, and bars 1608 and 1610, that are connected to form a rigid structure that is accessory attachment 1600. In an aspect, accessory attachment 1600 can be supported by ball perch 100, by placing accessory attachment 1600 on ball perch 100 such that horizontal bar 1602 is supported by elongated bars 108 and 110, at bar attachment points 104 and 106, respectively. In this configuration, accessory attachment 1600 can be used to support a sports ball such as a basketball, a soccer ball, a football, or a volleyball. Other articles of fitness equipment such as a foam roll, a rolled-up yoga mat, and so on, may also be supported by accessory attachment 1600.

A substantially coplanar structure formed by bars 1608 and 1610, and the horizontal portions of L-shaped bars 1604 and 1606, along with the portions of L-shaped bars 1604 and 1606 that are out of the plane of the coplanar structure, forms a three-dimensional framework that provides support to a ball that is larger than the three-dimensional framework, such as a basketball, a volleyball, a football or a soccer ball. A substantially coplanar structure formed by bars 1608 and 1610, and the horizontal portions of L-shaped bars 1604 and 1606 can be used to support items such as a foam roll or a rolled-up yoga mat.

Figure 17A:
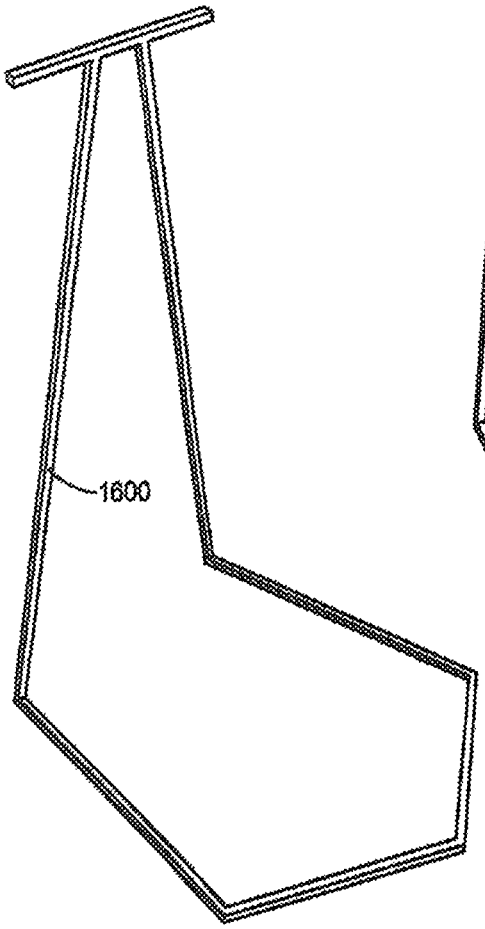
FIG. 17A and FIG. 17B is a pictorial drawing depicting a view of two accessory attachments.
Figure 17B:
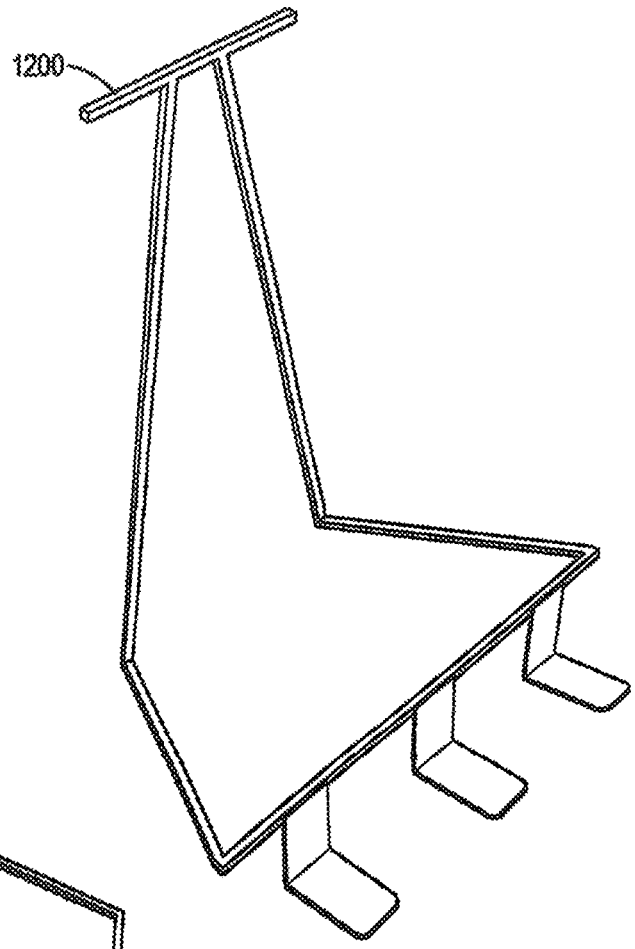

FIG. 17A and FIG. 17B is a pictorial drawing depicting a view 1700 of accessory attachments 1200 and 1600, to show a functional design comparison between accessory attachments 1200 and 1600. View 1700 is a comparative view of accessory attachments 1200 and 1600, showing structural design differences that enable each of accessory attachment 1200 and 1600 to support specific kinds of exercise equipment or accessories.

Figure 18:
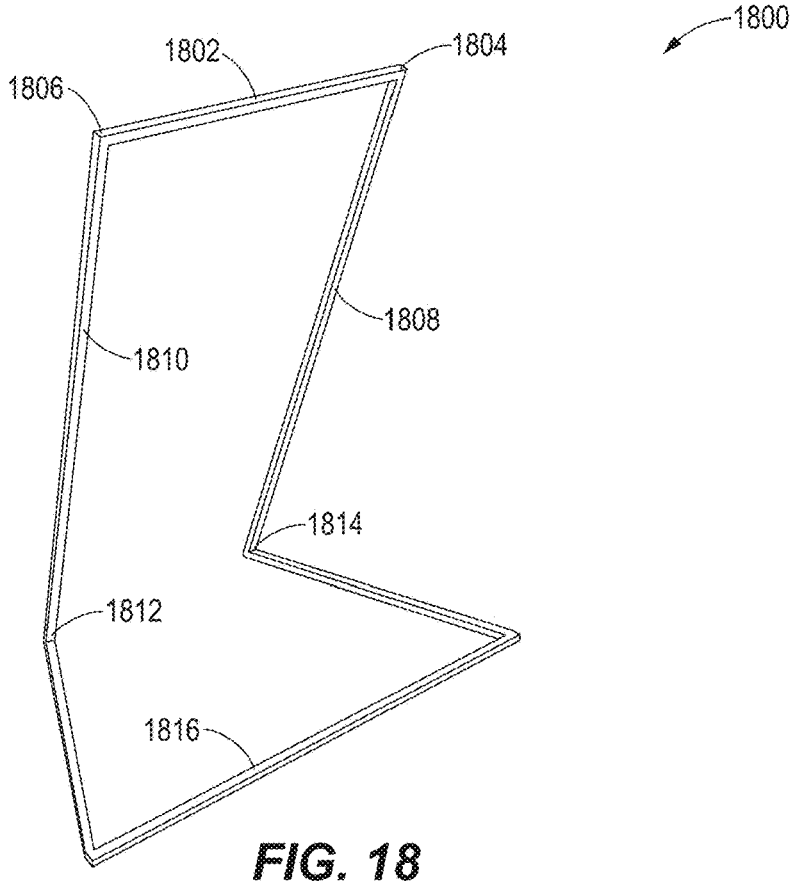
FIG. 18 is a pictorial drawing depicting an accessory attachment.

FIG. 18 is a pictorial drawing depicting accessory attachment 1800. As depicted, accessory attachment 1800 includes horizontal bar 1802, angular bar 1808, angular bar 1810, and horizontal bar 1816, connected end-to-end to form a rigid structure that is accessory attachment 1800. In an aspect, angular bars 1808 and 1810 connect with horizontal bar 1802 at corners 1804 and 1806, respectively. Angular bars 1808 and 1810 also include vertices 1814 and 1812, respectively.

In an aspect, accessory attachment 1800 can be supported by ball perch 100, by placing accessory attachment 1800 on ball perch 100 such that horizontal bar 1802 is supported by elongated bars 108 and 110, at bar attachment points 104 and 106, respectively. In this configuration, a substantially coplanar surface formed by horizontal bar 1802, and the portions (sides) of angular bars 1808 and 1810 connected to horizontal bar 1802 are in a substantially vertical plane. A support structure comprised of horizontal bar 1816 and the portions (sides) of angular bars 1808 and 1810 connected to horizontal bar 1816 may be configured such that the ends of horizontal bar 1816 are at a higher elevation than vertices 1812 and 1814. In this configuration, accessory attachment 1800 can be used to support fitness equipment or a fitness accessories such as a foam roll, a rolled-up yoga mat, or a Pilates Wheel®.

Any accessory placed on the support structure of accessory attachment 1800 is pulled towards the vertical planar surface formed by horizontal bar 1802, and the portions (sides) of angular bars 1808 and 1810 connected to horizontal bar 1802, due to gravitational force. Thus, a combination of the support surface and the vertical portions of angular bars 1808 and 1810 collectively support an item placed on accessory attachment 1800. In an aspect, multiple accessory attachments 1800 can be interconnected with one another, as described subsequently.

Figure 19:
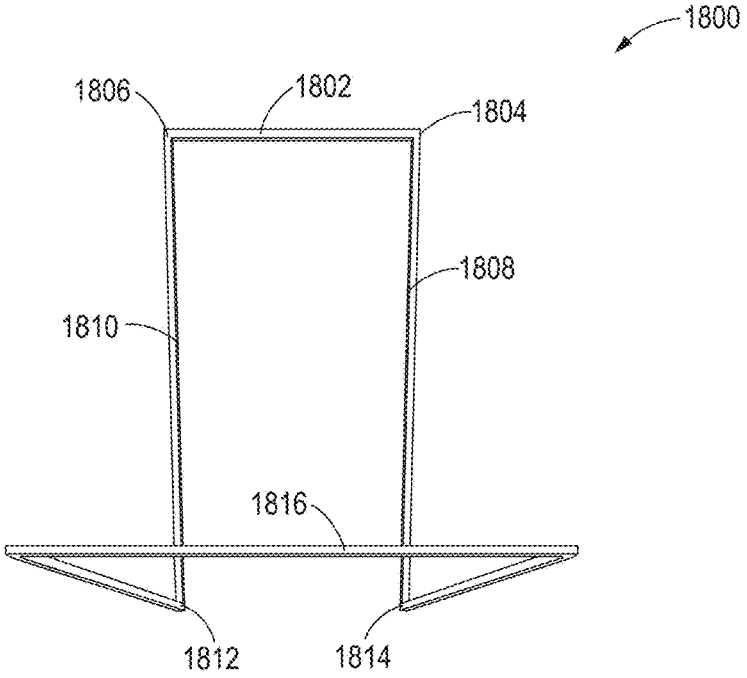
FIG. 19 is a pictorial drawing depicting an accessory attachment.

FIG. 19 is a pictorial drawing depicting accessory attachment 1800. FIG. 19 is an alternate view of accessory attachment 1800. As depicted, FIG. 19 depicts accessory attachment 1800 showing horizontal bar 1802, angular bar 1808, angular bar 1810, horizontal bar 1816, corners 1804 and 1806, and vertices 1814 and 1812.

Figure 20:
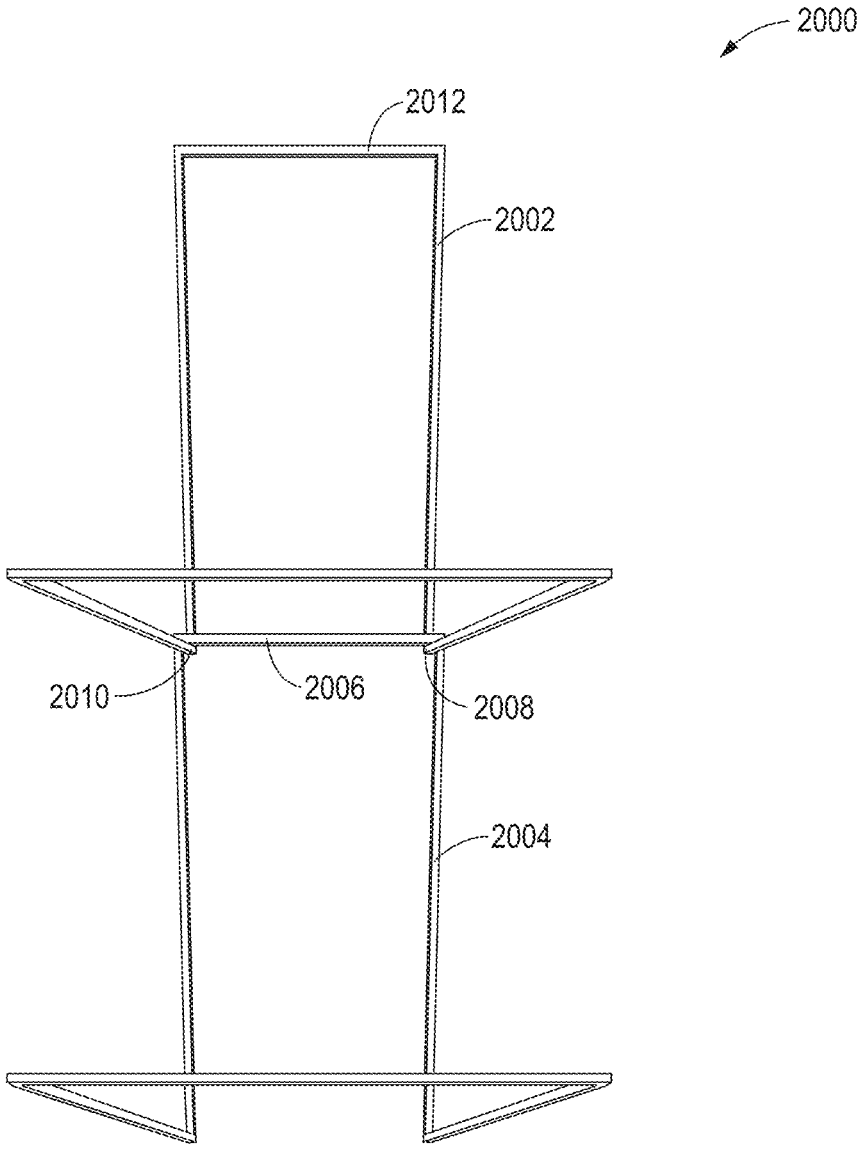
FIG. 20 is a pictorial drawing depicting a view of a first accessory attachment connected to a second accessory attachment.

FIG. 20 is a pictorial drawing depicting a view 2000 of a first accessory attachment 2002 connected to a second accessory attachment 2004. As depicted, horizontal bar 2006 of second accessory attachment 2004 (corresponding to horizontal bar 1802 of accessory attachment 1800) may be connected to and supported by vertices 2008 and 2010 of first accessory attachment 2002 (corresponding to vertices 1814 and 1812, respectively of accessory attachment 1800). In this configuration, an assembly comprising first accessory attachment 2002 connected to second accessory attachment 2004 can be supported by ball perch 100, where horizontal bar 2012 of first accessory attachment 2002 is supported by elongated bars 108 and 110, at bar attachment points 104 and 106, respectively. In essence, vertices 2008 and 2010 act as bar attachment points 106 and 104 respectively, to support accessory attachment 2004.

Figure 21:
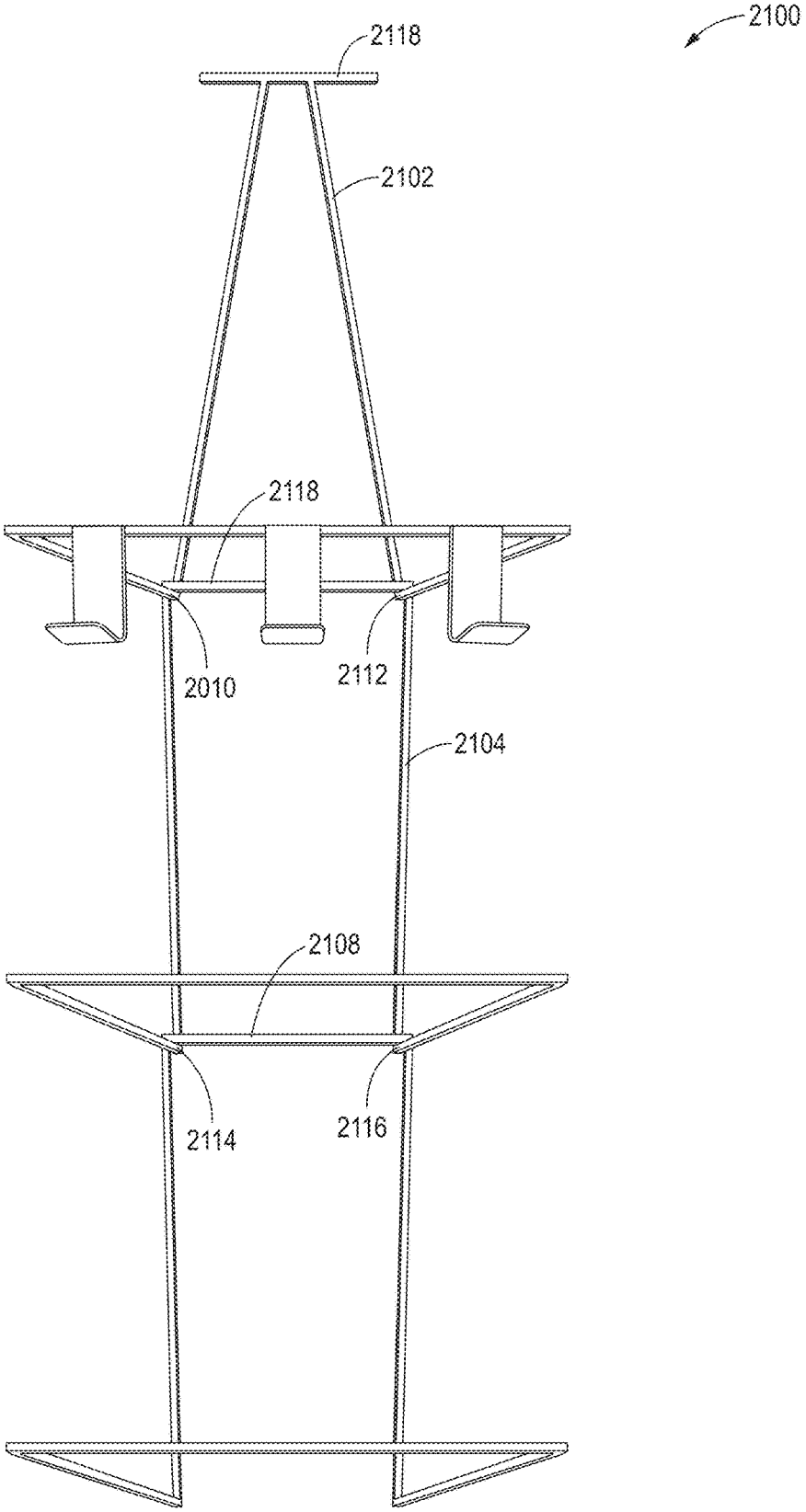
FIG. 21 is a pictorial drawing depicting a view of a first accessory attachment connected to a second accessory attachment, with the second accessory attachment further connected to a third accessory attachment.

FIG. 21 is a pictorial drawing depicting a view of first accessory attachment 2102 (similar to accessory attachment 1200) connected to second accessory attachment 2104 (similar to accessory attachment 1800), with second accessory attachment 2104 further connected to third accessory attachment 2106 (similar to accessory attachment 1800). As depicted, horizontal bar 2108 of third accessory attachment 2106 (corresponding to horizontal bar 1802 of accessory attachment 1800) is supported by vertices 2114 and 2116 of second accessory attachment 2104 (corresponding to vertices 1812 and 1814 of accessory attachment 1800, respectively).

In an aspect, horizontal bar 2120 of second accessory attachment 2104 (corresponding to horizontal bar 1802 of accessory attachment 1800) is supported by vertices 2110 and 2112 of first accessory attachment 2102 (corresponding to vertices 1216 and 1218 of accessory attachment 1200, respectively).

In essence, third accessory attachment 2106 is supported by second accessory attachment 2104, and a combination of second and third accessory attachments 2104 and 2106 is supported by first accessory attachment 2102. This combination of accessory attachments 2102, 2104 and 2106 may be further supported by ball perch 100, via horizontal bar 2118 (corresponding to horizontal bar 1202 of accessory attachment 1200) being supported on elongated bars 108 and 110, respectively, at bar attachment points 104 and 106, respectively. When the combination of accessory attachments 2102, 2104 and 2106 is supported by ball perch 100, ball perch 100 can further support exercise ball 126, as described previously. When the combination of accessory attachments 2102, 2104 and 2106 is supported by ball perch 100, additional fitness accessories can be supported by any combination of accessory attachments 2102, 2104 and 2106.

Figure 22:
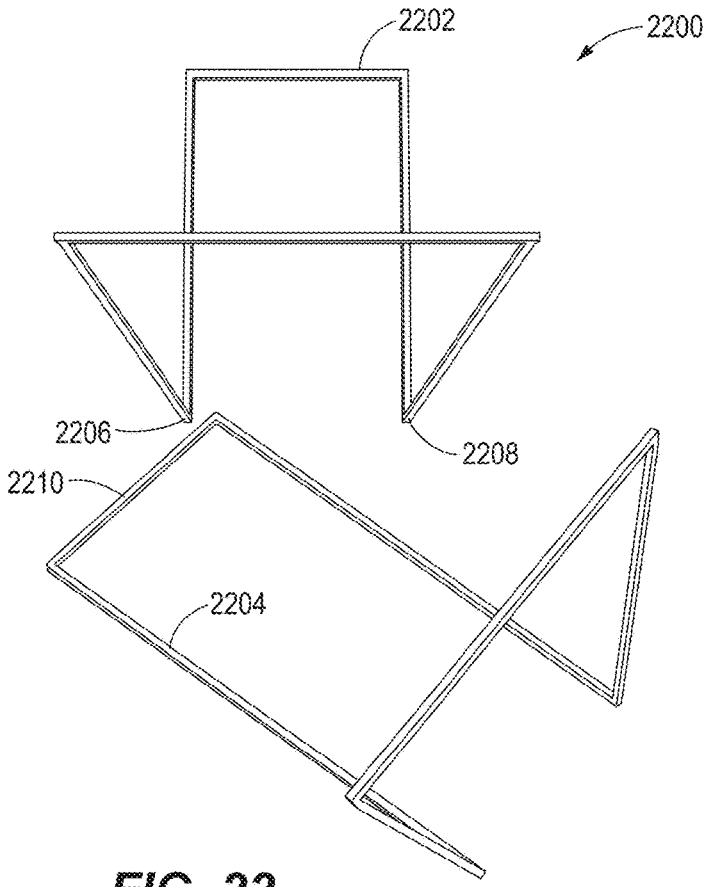
FIG. 22 is a pictorial drawing depicting a view of a first accessory attachment and a second accessory attachment in a process of being connected to each other.

FIG. 22 is a pictorial drawing depicting a view 2200 of first accessory attachment 2202 and second accessory 2204 attachment in a process of being connected to each other. Each of first accessory attachment 2102 and second accessory attachment 2104 may be similar to accessory attachment 1800. In view 2300, second accessory attachment 2104 is placed such that View 2200 shows horizontal bar 2210 of accessory attachment 2204 (corresponding to horizontal bar 1802 of accessory attachment 1800), and vertices 2206 and 2208 (corresponding to vertices 1812 and 1814 of accessory attachment 1800, respectively).

Figure 23:
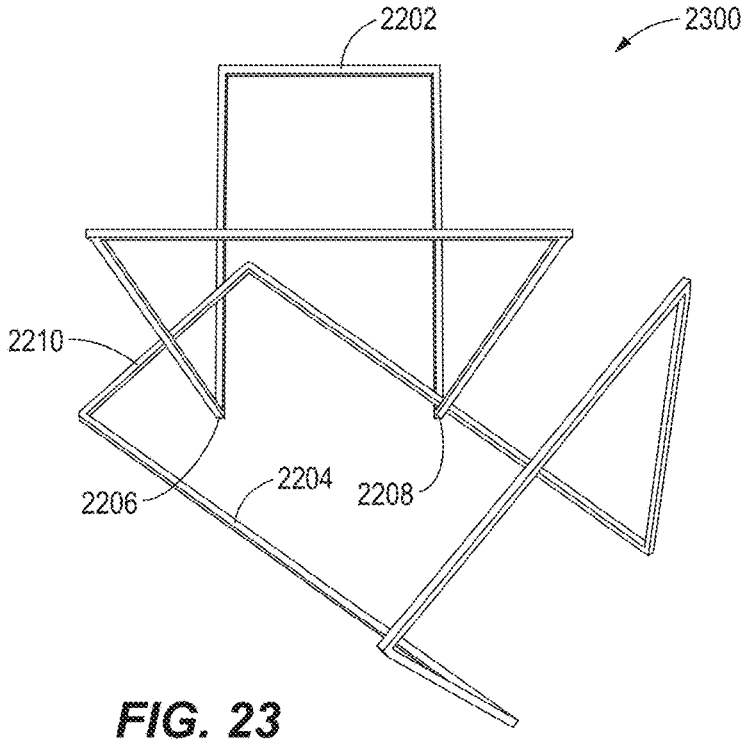
FIG. 23 is a pictorial drawing depicting a view of a first accessory attachment and a second accessory attachment in a process of being connected to each other.

FIG. 23 is a pictorial drawing depicting a view 2300 of first accessory attachment 2202 and second accessory attachment 2204 in a process of being connected to each other. As depicted in view 2300, horizontal bar 2210 is in a process of being moved to engage with vertices 2206 and 2208.

Figure 24:
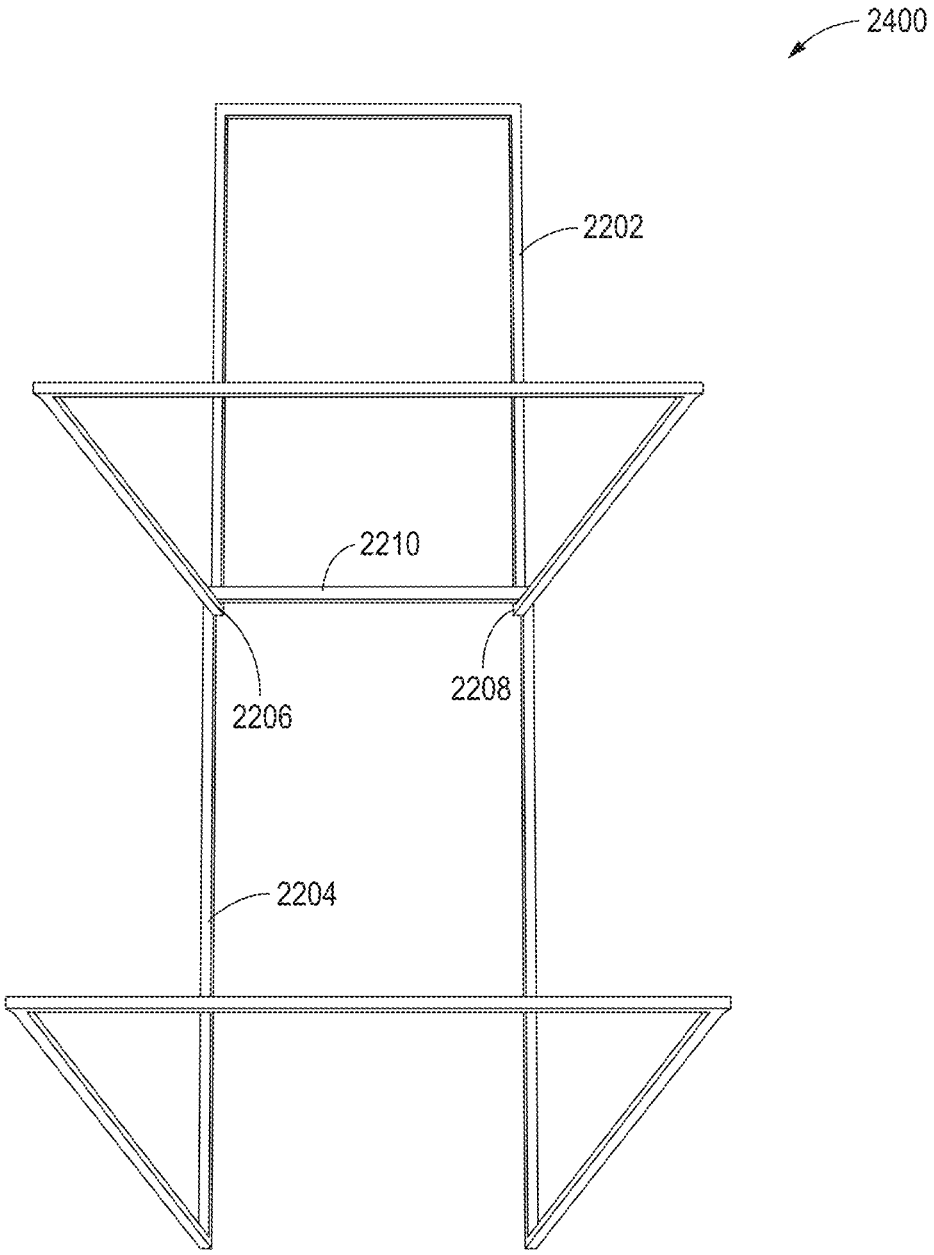
FIG. 24 is a pictorial drawing depicting a view of a first accessory attachment and a second accessory attachment connected to each other.

FIG. 24 is a pictorial drawing depicting a view of first accessory attachment 2202 and second accessory attachment 2204 connected to each other. This configuration is similar to the configuration presented in FIG. 20. As depicted in FIG. 24, horizontal bar 2210 of second accessory attachment 2204 (corresponding to horizontal bar 1802 of accessory attachment 1800) may be connected to vertices 2206 and 2208 of first accessory attachment 2202 (corresponding to vertices 1814 and 1812, respectively of accessory attachment 1800). In this configuration, the assembly comprising first accessory attachment 2202 connected to second accessory attachment 2204 can be supported by ball perch 100, similar to as described for FIG. 20.

Figure 25:
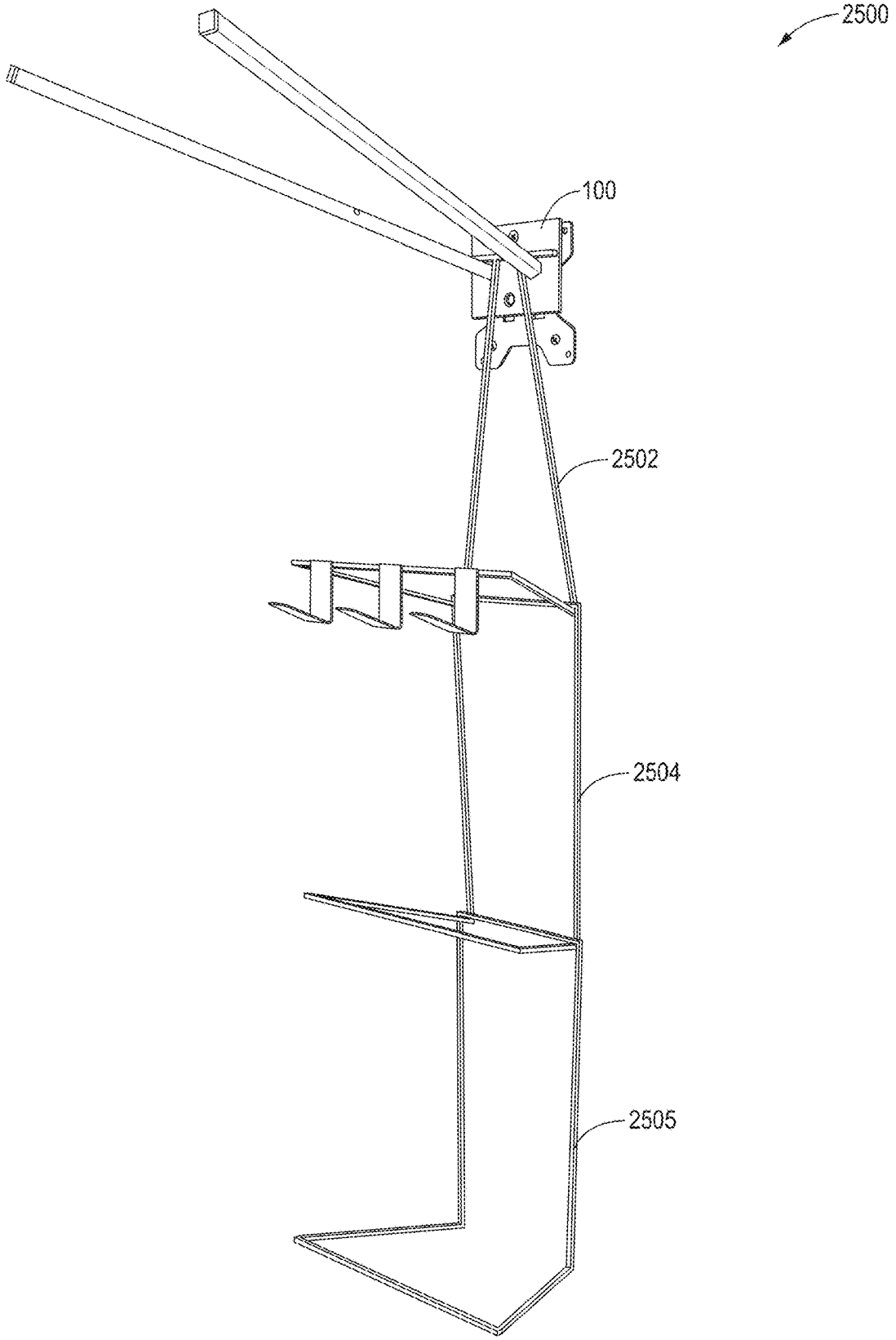
FIG. 25 is a pictorial drawing depicting a view of three sequentially-connected accessory attachments connected to a ball perch.

FIG. 25 is a pictorial drawing depicting a view 2500 of three sequentially-connected accessory attachments connected to ball perch 100, using the connectivity techniques described above. In view 2500, accessory attachment 2505 (similar to accessory attachment 1800) is supported by accessory attachment 2504 (similar to accessory attachment 1800). The combination of accessory attachments 2504 and 2505 is supported by accessory attachment 2502 (similar to accessory attachment 1200). The combination of accessory attachments 2502, 2504, and 2505 is supported by ball perch 100. Ball perch 100 may be used to support exercise ball 126, while accessory attachments 2502, 2504 and 2505 may be used to support any combination of fitness/exercise equipment or accessories.

Figure 26:
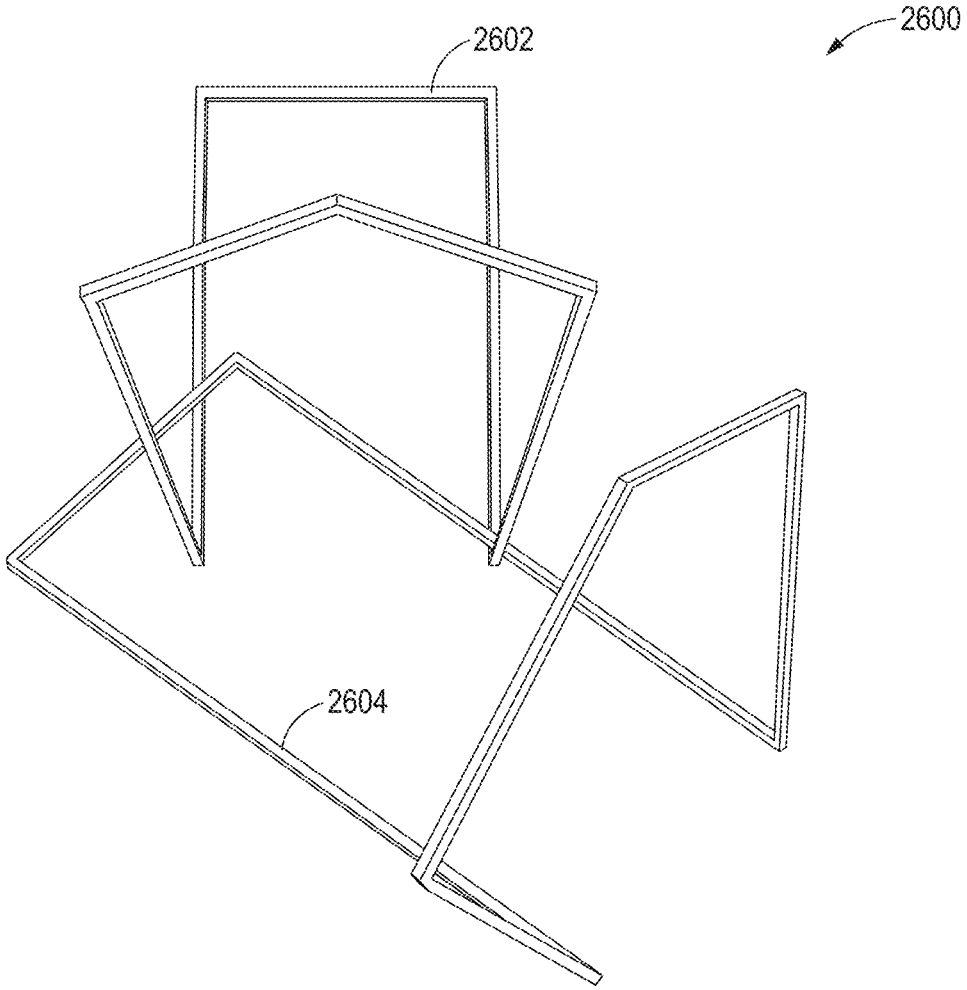
FIG. 26 is a pictorial drawing depicting is a diagram depicting a view of a first accessory attachment and a second accessory attachment in a process of being connected to each other.

FIG. 26 is a pictorial drawing depicting is a diagram depicting a view 2600 of first accessory attachment 2602 (similar to accessory attachment 1600) and second accessory attachment 2604 (similar to accessory attachment 1600) in a process of being connected to each other, in a manner similar to that described in FIGS. 22 through 24.

Figure 27:
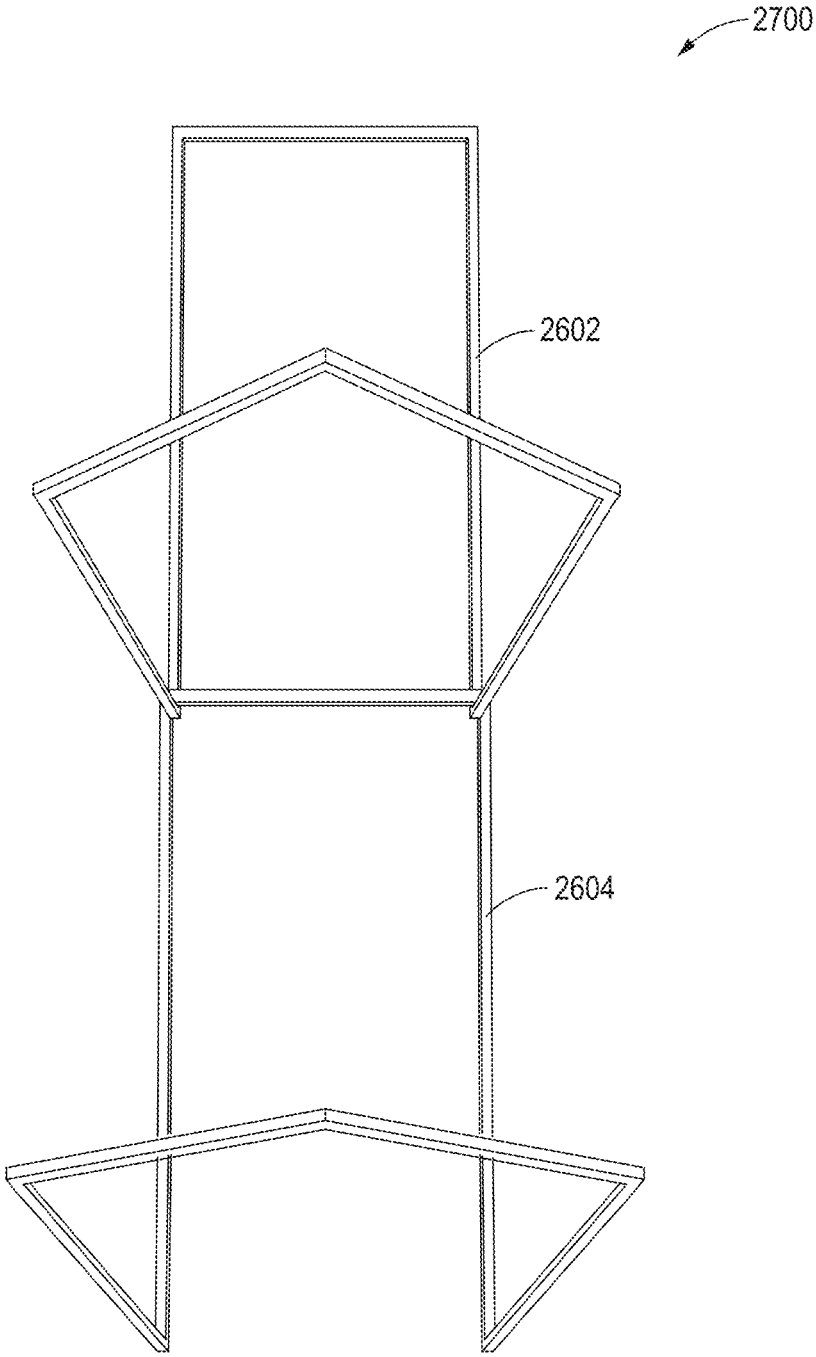
FIG. 27 is a pictorial drawing depicting a view of a first accessory attachment and a second accessory attachment connected to each other.

FIG. 27 is a pictorial drawing depicting a view 2700 of first accessory attachment 2602 and second accessory attachment 2604 connected to each other. This connectivity is similar to the connectivity depicted in FIG. 24.

Figure 28:
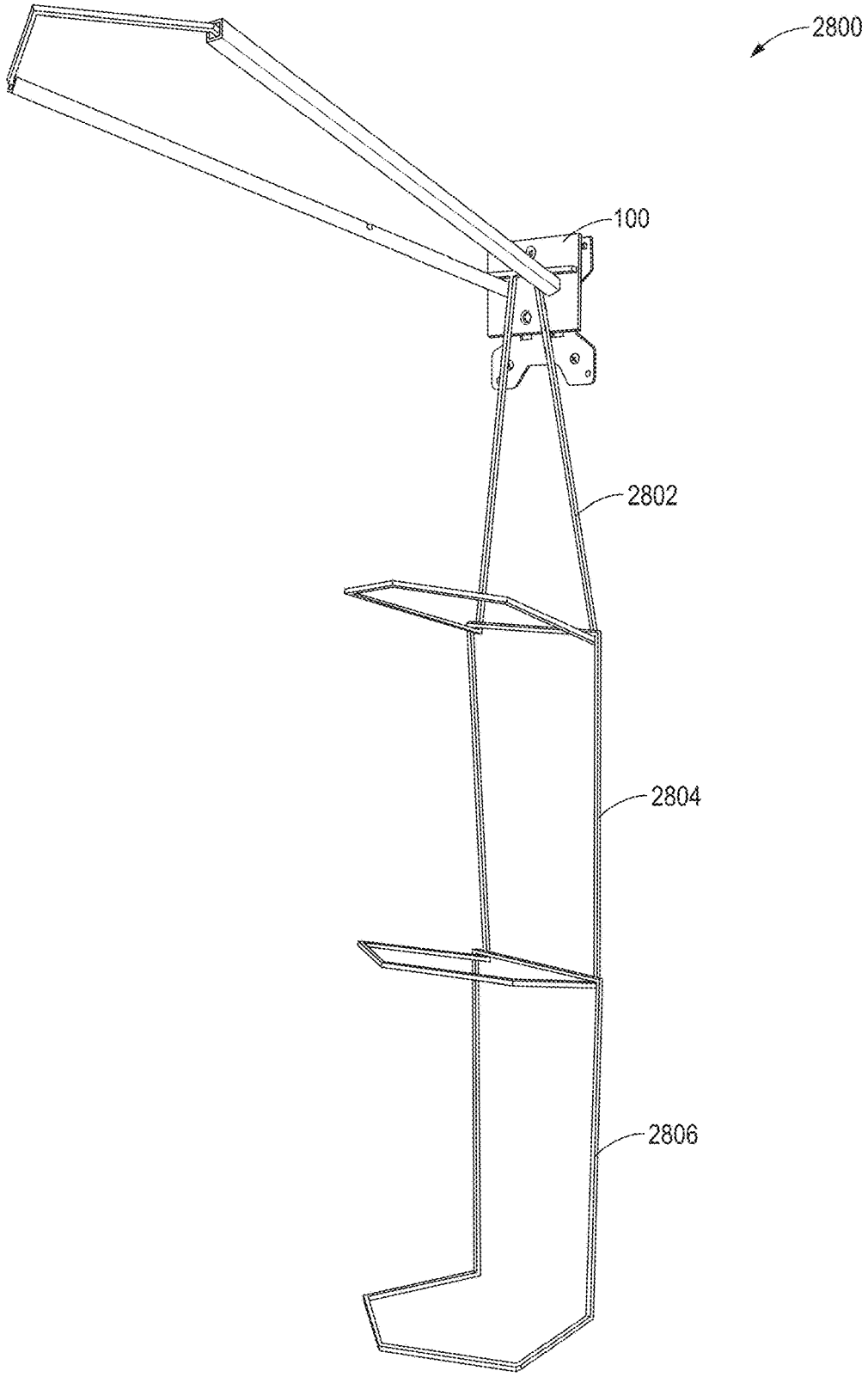
FIG. 28 is a pictorial drawing depicting a view of three sequentially-connected accessory attachments connected to a ball perch.

FIG. 28 is a pictorial drawing depicting a view 2800 of three sequentially-connected accessory attachments 2802, 2804 and 2806, collectively connected to ball perch 100. View 2800 shows ball perch 100 configured in a manner similar to the embodiment presented in FIGS. 9-11. Ball perch 100 may be used to support exercise ball 126, while accessory attachments 2802, 2804 and 2806 can be used to support any combination of exercise/fitness equipment or accessories. As depicted in FIG. 28, each of accessory attachment 2802, 2804 and 2806 is similar to accessory attachment 1600.

Figure 29:
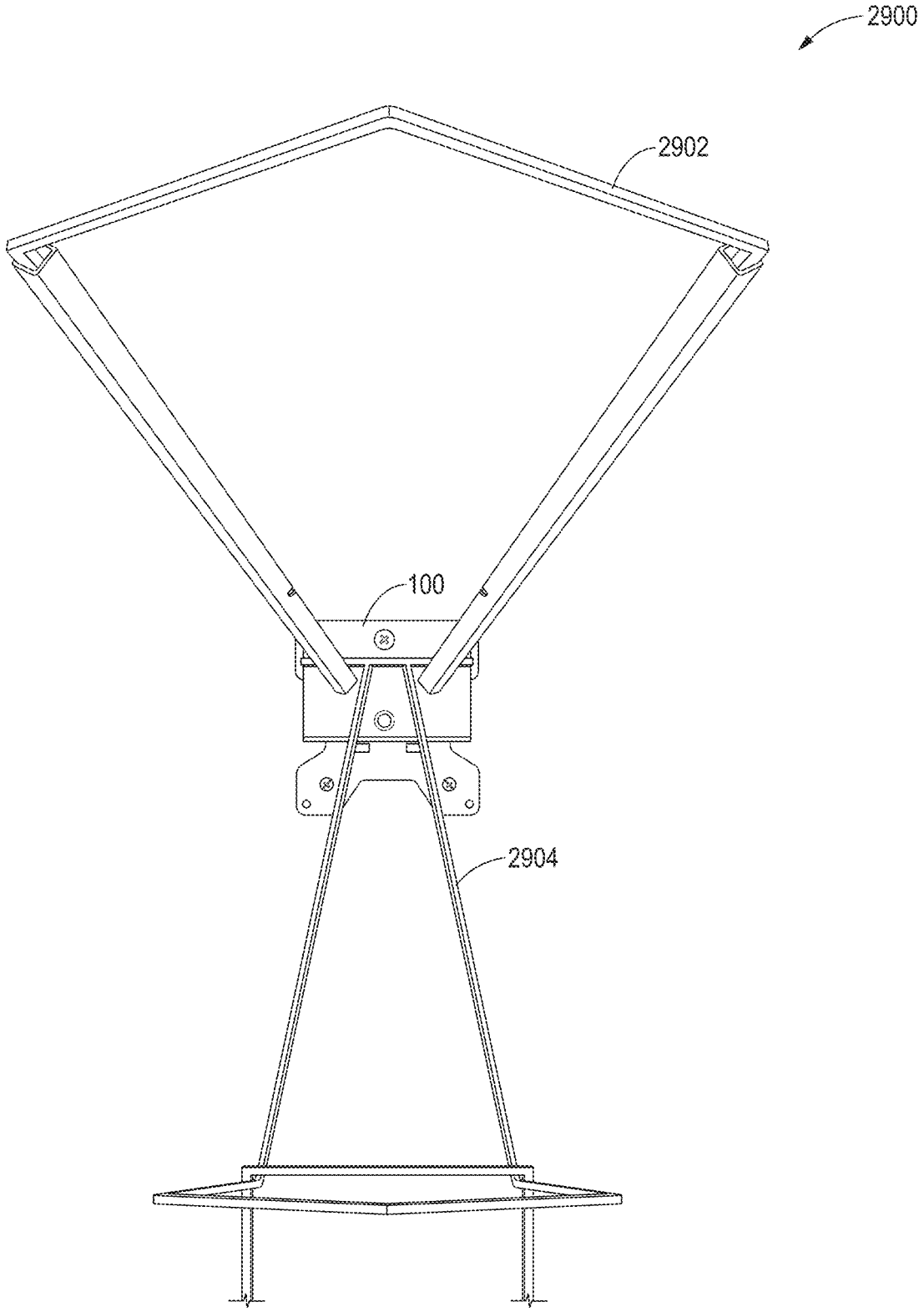
FIG. 29 is a pictorial drawing depicting a view of an accessory attachment connected to a ball perch.

FIG. 29 is a pictorial drawing depicting a view 2900 of accessory attachment 2904 connected to ball perch 100. FIG. 29 is a close-up view of view 2800—accessory attachment 2904 corresponds to accessory attachment 2802. FIG. 29 also depicts support attachment 2902, that is similar to support attachment 700.

Figure 30:
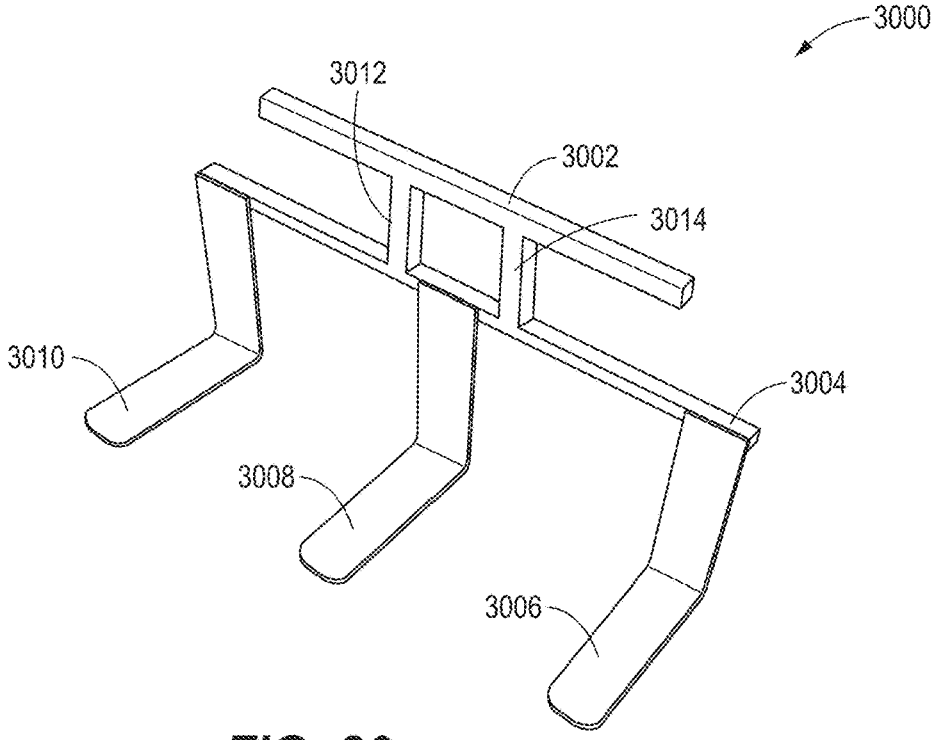
FIG. 30 is a pictorial drawing depicting an accessory attachment.

FIG. 30 is a pictorial drawing depicting an accessory attachment 3000. Accessory attachment 3000 is essentially similar to rigid attachment 502. As depicted, accessory attachment 3000 is comprised of horizontal bar 3002, vertical bars (cross beams/bars) 3012 and 3014 that connect horizontal bar 3002 to horizontal bar 3004, and three L-shaped extensions 3006, 3008, and 3010, that are connected to horizontal bar 3004. In an aspect, horizontal bar 3002 may be used to support accessory attachment 3000 on ball perch 100. Specifically, horizontal bar 3002 may be inserted into notches 116 and 118, or bar 3002 may be supported on elongated bars 108 and 110, at bar attachment points 104 and 106, respectively. Functionally, accessory attachment 3000 is similar to rigid attachment 502.

Figure 31:
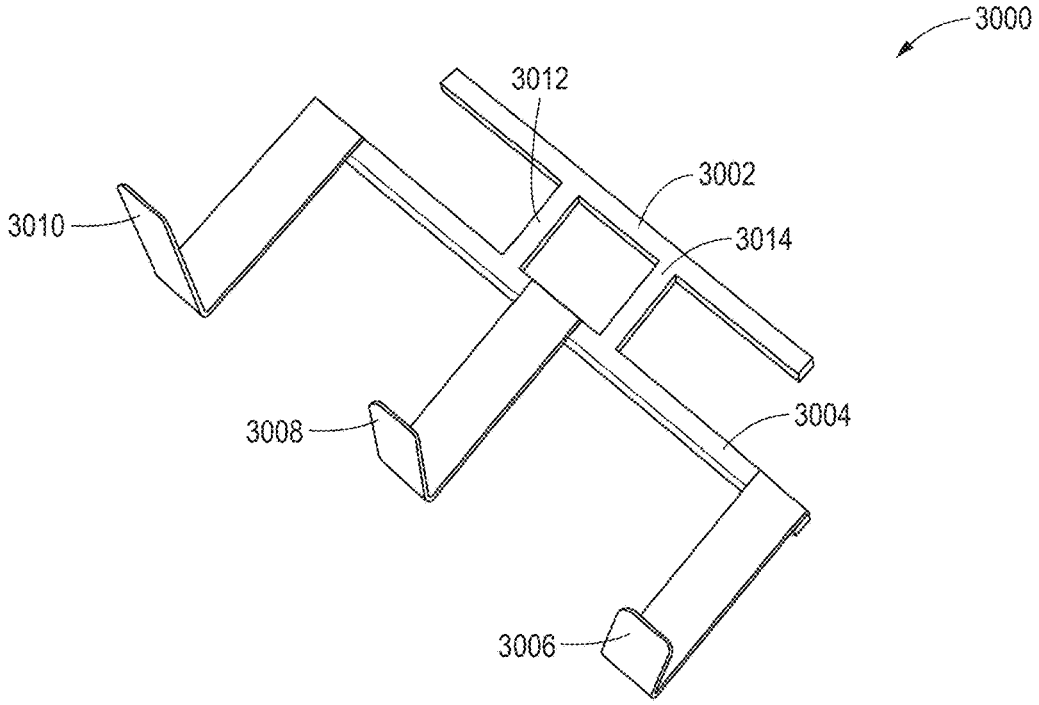
FIG. 31 is a pictorial drawing depicting an accessory attachment.

FIG. 31 is a pictorial drawing depicting accessory attachment 3000. FIG. 31 depicts an alternate view of accessory attachment 3000. FIG. 31 depicts horizontal bar 3002, vertical bars (cross beams/bars) 3012 and 3014 that connect horizontal bar 2003 to horizontal bar 3004, and three L-shaped extensions 3006, 3008, and 3010 that are connected to horizontal bar 3004.

Figure 32:
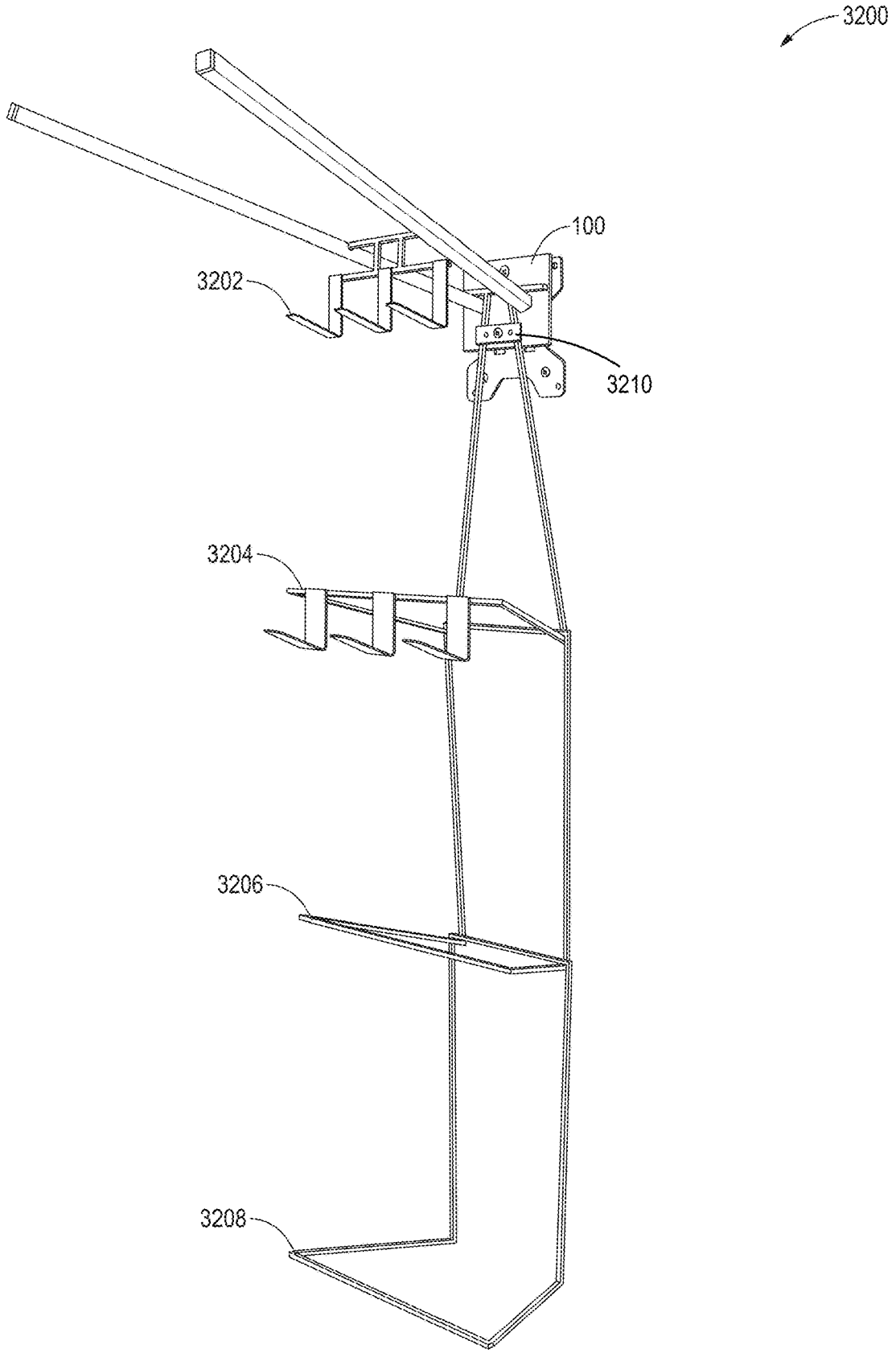
FIG. 32 is a pictorial drawing depicting a view of three sequentially-connected accessory attachments connected to a ball perch.

FIG. 32 is a pictorial drawing depicting a view 3200 of three sequentially-connected accessory attachments connected to ball perch 100. View 3200 depicts ball perch 100. Rigid attachment 3202 (similar to rigid attachment 502) is attached to ball perch 100 via insertion into notches 116 and 118. As depicted, accessory attachment 3208 is supported by accessory attachment 3206. A combination of accessory attachments 3206 and 3208 is supported by accessory attachment 3204. The combination of accessory attachments 3204, 3206 and 3208 is supported by ball perch 100. Ball perch 100 can be used to support exercise ball 126. A combination of rigid attachment 3202 and accessory attachments 3204, 3206 and 3208 can be used to support any combination of articles of fitness/exercise equipment.

View 3200 also depicts locking mechanism 3210. Locking mechanism 3210 may be used to secure the hanging racks (e.g., any accessory attachments attached to/hanging from ball perch 100) more closely along the wall or rigid vertical surface which they hang against. In an aspect, locking mechanism is comprised of a plate that attaches to the lower Base Plate mounting hole (i.e., wall mount hole 122) along with the mounting screw that is used to secure ball perch 100 to the rigid vertical surface. The plate can be rotated into vertical position to release the rack (i.e., an accessory attachment), and turned horizontally to engage the rack bars and hold them between it and the wall mounted base plate 102.

Figure 33:
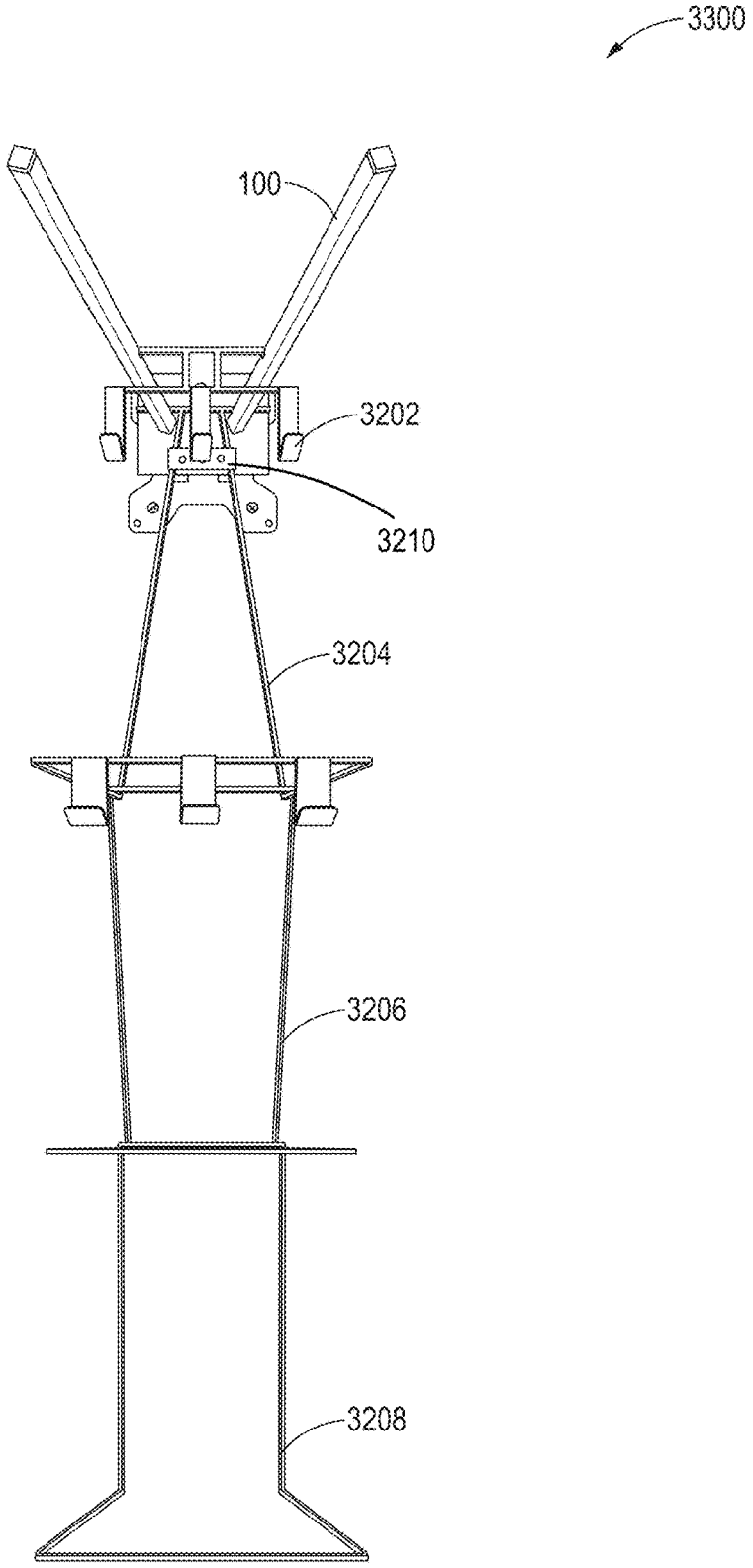
FIG. 33 is a pictorial drawing depicting a view of three sequentially-connected accessory attachments connected to a ball perch.

FIG. 33 is a pictorial drawing depicting a view 3300 of three sequentially-connected accessory attachments connected/attached to ball perch 100. View 3300 is an alternate view of the ball perch and accessory attachments presented in view 3200. View 3200 depicts ball perch 100, rigid accessory 3202, locking mechanism 3210, and accessory attachments 3204, 3206 and 3208.

Figure 34:
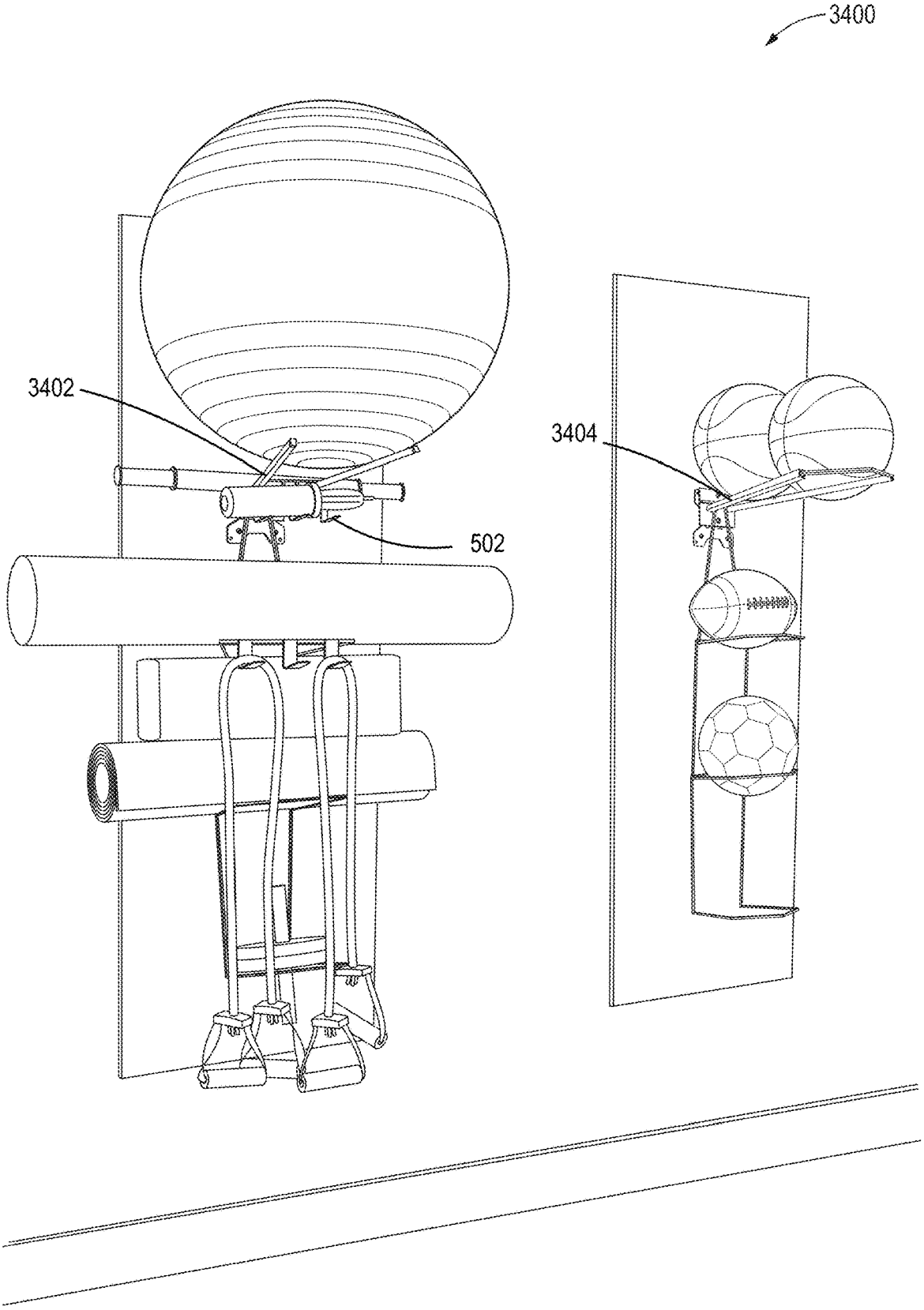
FIG. 34 is a pictorial drawing depicting a view of two ball perches supported by support stands.

FIG. 34 is a pictorial drawing depicting a view 3400 of two ball perches 3402 and 3404. Each ball perch is fastened to an attachment board, which is further attached to a wall, and includes a combination of rigid attachment 502, and/or other accessory attachments described herein. As depicted in view 3400, the ball perch systems associated with ball perches 3402 and 3404 support an exercise ball, a foam roll, a rolled-up yoga mat, two basketballs, a football, and a soccer ball. As depicted, each of ball perches 3402 and 3404 is attached to an attachment board, which is further attached to a wall. In another embodiment, each of ball perches 3402 and 3404 is attached to the wall directly, without needing to be attached to an attachment board.

Figure 35:
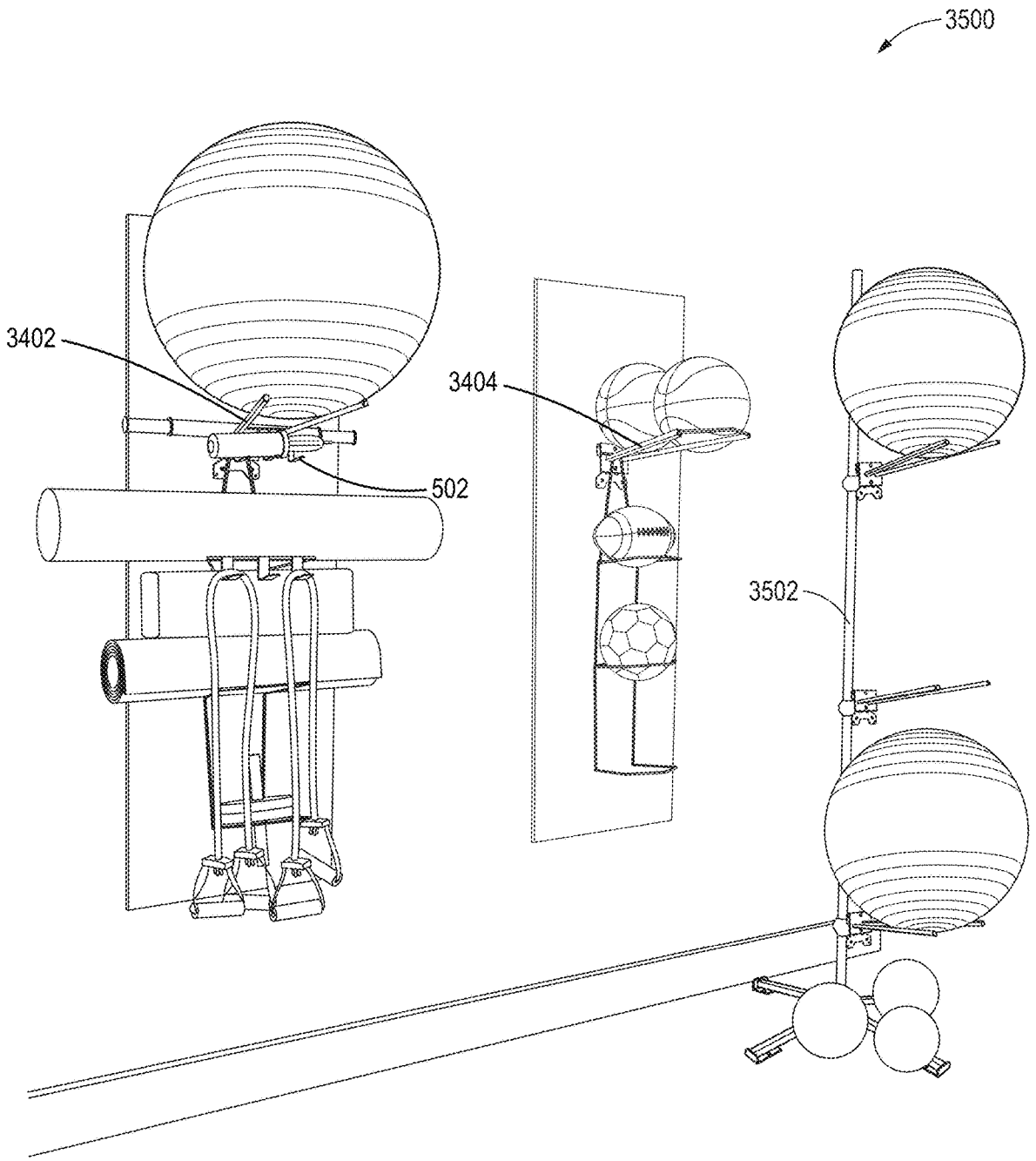
FIG. 35 is a pictorial drawing depicting a view of three ball perches supported by support stands.

FIG. 35 is a diagram depicting a view 3500 of ball perches 3402 and 3404 mounted on a wall, and a plurality of ball perches supported by support stand 3502 (i.e., a Ball Perch Tree). Support stand 3502 may be similar to vertical stand 402. Support stand 3502 includes multiple fastened ball perches. Each ball perch system depicted in view 3500 includes a combination of rigid attachment 502, and/or other accessory attachments described herein. Support stand 3502 includes three ball perches attached, and is shown to support two exercise balls. As depicted in view 3500, the multiple ball perch systems support multiple exercise balls, a foam roll, a rolled-up yoga mat, two basketballs, a football, and a soccer ball.

The Ball Perch System is a modular wall-hanging storage and organization system for gymnasium/fitness equipment and accessories that is comprised of multiple components, 1.) One wall mounting plate with two attached extending bars (i.e., ball perch 100), 2.) Three "L-Shape Attachment Racks which attach sequentially to each other and hang down from the bars located above them and attached to the adjacent wall (e.g., any combination of accessory attachments 1200, 1600 and 1800), 3) One "M-Shape" hanging "Fingers" attachment (i.e., rigid attachment 502) that is attached at one of two different locations on the extending bars, and 4) One Chevron Bar insert (i.e., support attachment 700) that is inserted in the ends of the extending bars in one of the three variations of the Ball Perch system.

The Ball Perch system comes in three variations:

The Ball Perch Classic is a two piece set that includes the wall mounted extending bars (i.e., ball perch 100) and "M-Shape" hanging "Fingers" attachment (i.e., rigid attachment 502). This embodiment is depicted in FIGS. 5 and 6.

The Ball Perch Fitness is a five-component set that includes the mounted extended bars (i.e., ball perch 100), the "Fingers" hanging attachment (i.e., rigid attachment 502), and three wider and slightly protruding "L-Shaped" hanging racks (i.e., any combination of accessory attachments 1200, 1600 and 1800), one of which has three large accessory hook attached to the front of the rack (i.e., accessory attachment 1200). This set is designed for the gym and studio environment, but is versatile to serve in a variety of settings. This embodiment is depicted in FIGS. 25, 32, and 33.

The Ball Perch Sport is also a five-piece set that includes the wall mounted bars (i.e., ball perch 100), but comes with three slightly different "L-Shaped" hanging racks (e.g., accessory attachment 1600) and the Chevron Bar insert (i.e., support attachment 700) for the extending bars. This set is designed to hold basketballs, soccer balls, footballs, volleyballs as well as most of the exercise equipment and accessories the Fitness version holds. This embodiment is depicted in FIG. 28.

All three versions of the Ball Perch have a versatile design that enables them to store a variety of other sports and fitness equipment accessories including multiple golf clubs, baseball gloves, helmets, weight lifting belts, all in one place, with a very compact and space efficient design that takes up little wall space and no floor space. The Ball Perch system is designed to be "up and away" from usable space in sports and fitness settings.

The Ball Perch Tree (e.g., multiple ball perches mounted on a vertical stand as depicted in view 400 and in FIG. 35) is another embodiment of the Ball Perch system of storage racks that is designed to be a compact standalone corner floor unit ideally suited to a larger commercial environment. It holds three Physio-Balls (Swiss Balls) simultaneously and provides easy access to each ball.

The Ball Perch Tree is a compact standalone floor unit that conveniently fits in the corner of a fitness space and takes up minimal floor space in the area least utilized in a fitness environment, a room corner.

The Ball Perch System described herein is a multi-part structure of overlapping, interconnected, and hanging components that attach as a set to a wall or a rigid vertical surface at varying heights. These components are composed of one wall attached two-beam extension beam attachment referred to as the "Beam and Base Plate" (also known as ball perch 100), and multiple (e.g., three) hanging racks (i.e., accessory attachments such as accessory attachments 1200, 1600 and 1800). The topmost rack that hangs down from ball perch 100 is referred to as the Top "L-Shaped Hanging Rack with Large Accessory Hooks" (accessory attachment 1200). The two remaining racks that attach to and hang down below the Top "L-Shaped Rack with Large Accessory Hooks" are referred to as the "L-Shaped" Attachment Racks (accessory attachment 1800). Another component is called the "M-Shape" Fingers Hanging Attachment (i.e., rigid attachment 502). Rigid attachment 502 attaches facing away from the attachment wall at either the Beam Notches (i.e., notch 116 and notch 118) or from the top of the Beams at the Beam Attachment Point to Base Plate (i.e., supported by elongated bars 108 and 110, at bar attachment points 104 and 106).

How the Ball Perch System Operates

The Ball Perch System is a wall hanging rack structure that permits the user to store a variety of sports and fitness equipment and accessories by placing an individual item on the protruding "shelf" elements of the system. The top most "shelf" is the Bars Accessory (e.g., ball perch 100) which enables the user to place Physio-Balls (Swiss Balls) on and between the bars, as described herein. Due to the bars' slight inclination and increasingly widening distance between the bars as they extend away from the wall the Physio-Ball (Swiss Ball) is held in place between the widening bars and "leaning" back against the wall caused by the gravitational pull resulting from the angle of the slanted bars towards the wall they are attached to.

The three racks (e.g., any combination of accessory attachments 1200, 1600 and 1800) hanging down from the Bars and Base Plate assembly are effectively three shelving units that protrude away from the wall they are hanging down along and leaning against. The physical shape of the three shelves has been designed to accommodate the storage of sports and fitness equipment that will be placed on top of them. Because the racks, like the Bars, also have a slight inclination towards the wall the entire structure (i.e., the Ball Perch System) hangs against, the stored items are held in place by the width, depth and angle of each rack platform. The Large Accessory Hooks (i.e., accessory attachment 1200), which also angle back towards the wall, are attached to the top hanging rack and can hold exercise bands and other sport and fitness accessories. Like the Large Accessory Hooks, the "M-Shape" Fingers Attachment (i.e., rigid attachment 502) provides additional hanging room to store items and accessories. Exercise bands often come in a variety of resistance levels and options. Having a second set of hooks can provide additional room for these bands to be stored in easily accessible and non-cluttered way. The versatility of the Ball Perch System allows for many other accessories to be stored than mentioned in this description.

Additional Embodiments

There are two additional versions of the Ball Perch System alongside the Fitness version discussed above. The Ball Perch Sport, which has been referenced earlier, is a variant of the Ball Perch Fitness and is designed to execute many of the same storage solutions as the Ball Perch Fitness but has specific and unique design advantages and capacities better suited for sports balls storage. The Ball Perch sport has a slightly different "Heptagonal" (i.e., a 7-sided frame that is accessory attachment 1600, made up of 7 non-coplanar rods as depicted in FIG. 16) shaped rack "shelves" (e.g., accessory attachment 1600) that allows the user to store up to five balls on a single four "shelf" (the Bars and three Racks) Ball Perch System set. The Sport version has the Main Large Chevron Bar insert (i.e., support attachment 700) that is added to The Bar ends (i.e., the ends of elongated bars 108 and 110 that are away from base plate 102) at their widest and most distant end from the Mounting Plate (base plate 102). The Chevron (support attachment 700) keeps any stored balls smaller than Swiss/Physio balls and other balls (e.g., basketballs, volleyballs, soccer balls, and footballs) from rolling off the Bar Rack caused by the downward slope of the widening bars as they extend away from the mounting wall. The "Heptagonal" shape of the Sport Rack platforms is ideally suited to holding Basketballs, Soccer balls, Volleyballs, Footballs, as well as Physio-Balls (Swiss Balls), foam rolls and all other accessories the Fitness version can hold. Because the Sport version Racks are 2.5" narrower than the Fitness version Racks (10" wide) some longer accessories like golf clubs may store more securely on the Fitness version of the Ball Perch Set. We hope to offer both versions of the Ball Perch System to the consumer due to the varying storage needs they may have.

Another version of the Ball Perch System is The Ball Perch Tree. The Ball Perch Tree is another embodiment of the Ball Perch system of storage racks that is designed to be a compact standalone corner floor unit ideally suited to a larger commercial environment or settings in which some floor space is available to store multiple Physio-Balls (Swiss Balls.) It holds three Physio-Balls (Swiss Balls) simultaneously and provides easy access to each ball. The Ball Perch Tree is a compact standalone floor unit that conveniently fits in the corner of a fitness space and takes up minimal floor space in the area least utilized in a fitness environment, a room corner. The Ball Perch Tree (presented in view 400) is comprised of five constituents. The first is an 8' vertical mounting bar (402) that slides into a four-prong folding floor stand (410). Three Ball Perch Beams and Base Plate elements (the three ball perches depicted in view 400) are attached to the mounting bar by way of three brackets approximately 26" apart (e.g., computer monitor pole mount brackets), the first being mounted approximately 12" above the floor. These measurements can be adjusted based on the size of the Physio-Balls (Swiss Balls) the consumer is storing. Additional Beams and Base Plate sets (i.e., ball perches similar to ball perch 100) can be added to the mounting bar if the consumer is using smaller balls and wants to have additional storage rack space on the Ball Perch Tree. The 12" space above the floor accommodates additional storage space under the Ball Perch Beams (i.e., under elongated bars 420 and 422), such as medicine and sports balls, balance pads, and an ab-roller. The Ball Tree can also be used to store a variety of sport balls if the Chevron Bar (i.e., support attachment 700) is added to each Ball Perch Beam End Cap or Attachment Opening. Due to its versatile design, the Ball Perch Tree can store exercise bands, balance pads, and many of the other fitness accessories that the Ball Perch Fitness and Ball Perch Sport sets store.

The Ball Perch Sport has very similar storage capacity and identical operation as the Ball Perch Fitness. Both are wall storage rack systems that store the same sports and fitness items on their four wall hanging "shelves." The Ball Perch Sport version has the added capacity to more easily store multiple sports balls than the Ball Perch Fitness. The four hanging "shelves" of the Sport version have the exact same storage operation as the Fitness version. The "M-Shape" Fingers accessory can be added to the Ball Perch Sport Beams allowing the Sports set to hold most of the same fitness accessories as the Fitness Version. The stored items are placed on the rack "shelves" in the four possible "shelf" locations. The addition of the "M-Shape" Fingers accessory permits the storage of exercise bands and other accessories on the Sport set, although, even without the Fingers accessory addition exercise bands and similar accessories can be stored directly over the Sport version Ball Perch Beams.

The primary Ball Perch Tree operation is to hold multiple Physio-Balls (Swiss Balls) on its three vertical beam attached Beams and Base Plate attachments. Like the Ball Perch Fitness and Ball Perch Sport, the Ball Perch Tree has a versatile and compact design to accommodate the storage of a variety of sport and fitness accessories, many of which may not be included in this description. The Ball Tree conveniently helps keep sport and fitness environments organized and safe by storing multiple Physio-Balls (Swiss Balls) and other sport and fitness accessories off the floor and out of the way of participants.

The Ball Perch System of wall hanging storage racks (Fitness and Sport) is a compact, versatile, space efficient, and convenient sports and fitness equipment and accessories storage solution the current marketplace does not offer and needs. Comparable storage solutions are bulky, inefficient, require considerable floor space, and are physically unattractive. The Ball Perch and Ball Perch Tree offer consumers a compact, simple, versatile and attractive storage solution that is suitable in all environments, large commercial settings, or smaller sports and fitness facilities. The Ball Perch System is a set of three storage solutions that meets the current market demands uniquely and effectively. From the Ball Perch Classic (a concise form of the Fitness model), to the Ball Perch Fitness, which is ideally suited for exercise and fitness equipment and accessories storage, to the Ball Perch Sport which is ideally suited for sports and fitness accessories storage, to the Ball Perch Tree, all three of these storage solutions offer the consumer products that the current marketplace does not offer, in a comparable compact, versatile, space-efficient, convenient, and attractive package. The Ball Perch System is uniquely positioned to serve specific sport and fitness storage needs that are not currently available to the consumer.

While FIGS. 1A, 1B, 2, 3, 4, 5, 6, 11, 14, 15, 25, 28, 29, 32, 33, 34, and 35 show embodiments of ball perch 100 mounted to a respective vertical surface via an intermediate mechanical coupling (e.g., mechanical mounting plate 103), some embodiments of ball perch 100 may be mounted directly on the rigid vertical surface (e.g., a wall), without using mechanical mounting plate 103.

Although the present disclosure is described in terms of certain example embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the scope of the present disclosure.

What is claimed is:

1. A ball perch system including a ball perch, the ball perch comprising:

a base plate configured to be rigidly mounted to a rigid vertical attachment surface;

a first elongated bar with a first end rigidly connected to the base plate at a first position; and a second elongated bar with a first end rigidly connected to the base plate at a second position different from the first position, wherein:

a first line joining the first position and the second position is approximately parallel to a horizontal axis;

the first elongated bar and the second elongated bar project outwards relative to the base plate from the first position and the second position, respectively;

a first distance as measured between the first position and the second position is smaller than a second distance as measured between a second end of the first elongated bar and a second end of the second elongated bar;

a second line joining the second end of the first elongated bar and the second end of the second elongated bar is approximately parallel to the first line;

the second end of the first elongated bar is at a higher elevation as compared to the first end of the first elongated bar;

the second end of the second elongated bar is at a higher elevation as compared to the first end of the second elongated bar; and a substantially rigid structure comprised of the vertical attachment surface, the base plate, the first elongated bar, and the second elongated bar is configured to support an exercise ball;

further comprising an angular support structure comprising four coplanar rods connected end-to-end, wherein a first unconnected end and a second unconnected end of the angular support structure are configured to be inserted into a first axial hole associated with the second end of the first elongated bar, and a second axial hole associated with the second end of the second elongated bar, respectively, and wherein a combination of the angular support structure, the first elongated bar, the second elongated bar, and the base plate forms a rigid framework that is adapted to provide further support to the exercise ball.

2. A ball perch system including a ball perch, the ball perch comprising:

a base plate configured to be rigidly mounted to a rigid vertical attachment surface;

a first elongated bar with a first end rigidly connected to the base plate at a first position; and a second elongated bar with a first end rigidly connected to the base plate at a second position different from the first position, wherein:

a first line joining the first position and the second position is approximately parallel to a horizontal axis;

the first elongated bar and the second elongated bar project outwards relative to the base plate from the first position and the second position, respectively;

a first distance as measured between the first position and the second position is smaller than a second distance as measured between a second end of the first elongated bar and a second end of the second elongated bar;

a second line joining the second end of the first elongated bar and the second end of the second elongated bar is approximately parallel to the first line;

the second end of the first elongated bar is at a higher elevation as compared to the first end of the first elongated bar;

the second end of the second elongated bar is at a higher elevation as compared to the first end of the second elongated bar; and a substantially rigid structure comprised of the vertical attachment surface, the base plate, the first elongated bar, and the second elongated bar is configured to support an exercise ball;

further comprising a three-dimensional, L-shaped frame with a support bar at a top end and a plurality of L-shaped structures at a bottom end, wherein:

the L-shaped frame is configured to be attached to the ball perch system at the first position and the second position while being supported by the first elongated bar and the second elongated bar via the support bar; and the L-shaped structures provide support to one or more articles that can be hung from the L-shaped structures.

3. A ball perch system including a ball perch, the ball perch comprising:

a base plate configured to be rigidly mounted to a rigid vertical attachment surface;

a first elongated bar with a first end rigidly connected to the base plate at a first position; and a second elongated bar with a first end rigidly connected to the base plate at a second position different from the first position, wherein:

a first line joining the first position and the second position is approximately parallel to a horizontal axis;

the first elongated bar and the second elongated bar project outwards relative to the base plate from the first position and the second position, respectively;

a first distance as measured between the first position and the second position is smaller than a second distance as measured between a second end of the first elongated bar and a second end of the second elongated bar;

a second line joining the second end of the first elongated bar and the second end of the second elongated bar is approximately parallel to the first line;

the second end of the first elongated bar is at a higher elevation as compared to the first end of the first elongated bar;

the second end of the second elongated bar is at a higher elevation as compared to the first end of the second elongated bar; and a substantially rigid structure comprised of the vertical attachment surface, the base plate, the first elongated bar, and the second elongated bar is configured to support an exercise ball;

further comprising a three-dimensional, L-shaped frame with a support bar at a top end and a support structure at a bottom end, wherein:

the L-shaped frame is configured to be attached to the ball perch system at the first position and the second position while being supported by the first elongated bar and the second elongated bar via the support bar; and the support structure at the bottom end is configured to support another exercise ball or one or more articles of fitness equipment.

4. The ball perch system of claim 3, wherein the support structure includes a plurality of coplanar rods joined end-to-end.

* * * * *